US011634975B2

(12) United States Patent
Jordan, Jr.

(10) Patent No.: US 11,634,975 B2
(45) Date of Patent: Apr. 25, 2023

(54) METHOD AND APPARATUS FOR PRODUCING WELL FLUIDS

(71) Applicant: Liquid Rod Lift, LLC, Houston, TX (US)

(72) Inventor: Henry Joe Jordan, Jr., Willis, TX (US)

(73) Assignee: Liquid Rod Lift, LLC, Houston, TX (US)

( * ) Notice: Subject to any disclaimer, the term of this patent is extended or adjusted under 35 U.S.C. 154(b) by 296 days.

(21) Appl. No.: 17/002,654

(22) Filed: Aug. 25, 2020

(65) Prior Publication Data

US 2021/0062628 A1 Mar. 4, 2021

Related U.S. Application Data

(60) Provisional application No. 63/026,548, filed on May 18, 2020, provisional application No. 62/893,090, filed on Aug. 28, 2019.

(51) Int. Cl.
*E21B 43/12* (2006.01)
*E21B 33/124* (2006.01)
(Continued)

(52) U.S. Cl.
CPC ..... *E21B 43/126* (2013.01); *E21B 33/124* (2013.01); *E21B 33/1208* (2013.01);
(Continued)

(58) Field of Classification Search
CPC ..... E21B 43/126; E21B 43/129; E21B 43/13; E21B 33/1208; E21B 33/124;
(Continued)

(56) References Cited

U.S. PATENT DOCUMENTS 731,241 A 6/1903 Steiner
2,277,306 A 3/1942 Coffey
(Continued)

FOREIGN PATENT DOCUMENTS

WO 2010002841 A2 1/2010
WO 2011069517 A1 6/2011
WO 2013086623 A1 6/2013

OTHER PUBLICATIONS

International Search Report and Written Opinion dated Nov. 30, 2020 for Application No. PCT/US2020/047980.
(Continued)

*Primary Examiner* — George S Gray
(74) *Attorney, Agent, or Firm* — Patterson + Sheridan, LLP

(57) ABSTRACT

A method of producing fluid from a wellbore includes operating a pump located proximate to a zone of fluid influx in the wellbore to draw a reservoir fluid from a reservoir into the wellbore at the zone of fluid influx. The pump is coupled to a tubing string extending above the pump, and a packer is coupled to the tubing string proximate to an upper end of the zone of fluid influx and seals an annular space around the tubing string. The method includes operating the pump to produce the reservoir fluid from the wellbore through the tubing string. A pump includes a drive chamber with a drive piston, a production chamber with a production piston coupled to the drive piston, and axially separated traveling valves.

18 Claims, 12 Drawing Sheets

(51) Int. Cl.

| | |
|---|---|
| ***E21B 33/12*** | (2006.01) |
| ***E21B 34/08*** | (2006.01) |
| ***F04B 53/10*** | (2006.01) |
| ***F04B 53/14*** | (2006.01) |
| ***F04B 53/20*** | (2006.01) |
| ***F04B 9/109*** | (2006.01) |
| ***F04B 9/113*** | (2006.01) |
| ***E21B 33/129*** | (2006.01) |

(52) U.S. Cl.
CPC ..... *E21B 34/08* (2013.01); *E21B 43/129* (2013.01); *F04B 9/1095* (2013.01); *F04B 9/113* (2013.01); *F04B 53/10* (2013.01); *F04B 53/14* (2013.01); *F04B 53/20* (2013.01); *E21B 33/1294* (2013.01); *E21B 2200/04* (2020.05)

(58) Field of Classification Search
CPC ..... E21B 33/1294; E21B 33/00; E21B 34/08; E21B 2200/04; F04B 53/10; F04B 53/14; F04B 53/20; F04B 53/126; F04B 9/1095; F04B 9/113
See application file for complete search history.

(56) References Cited

U.S. PATENT DOCUMENTS

| | | | | |
|---|---|---|---|---|
| 2,311,212 | A | | 2/1943 | Coberly |
| 2,420,151 | A | | 5/1947 | Renouf et al. |
| 2,631,541 | A | | 3/1953 | Dempsey |
| 2,983,227 | A | | 5/1961 | English |
| 3,123,007 | A | | 3/1964 | Orr |
| 3,222,994 | A | | 12/1965 | English |
| 3,912,420 | A | * | 10/1975 | Gault ..... F04B 47/02 417/260 |
| 3,918,845 | A | * | 11/1975 | Heard ..... F04B 3/00 417/260 |
| 4,013,385 | A | | 3/1977 | Peterson |
| 4,118,154 | A | | 10/1978 | Roeder |
| 4,403,919 | A | | 9/1983 | Stanton et al. |
| 4,405,291 | A | | 9/1983 | Canalizo |
| 4,490,095 | A | | 12/1984 | Soderberg |
| 4,551,075 | A | | 11/1985 | Canalizo |
| 4,611,974 | A | | 9/1986 | Holland |
| 4,616,981 | A | | 10/1986 | Simmons et al. |
| 4,861,239 | A | | 8/1989 | Simmons et al. |
| 5,494,102 | A | | 2/1996 | Schulte |
| 5,785,500 | A | | 7/1998 | Leniek |
| 6,131,660 | A | | 10/2000 | Stuebinger et al. |
| 6,193,476 | B1 | | 2/2001 | Sweeney |
| 6,598,681 | B1 | | 7/2003 | Berry |
| 6,817,409 | B2 | | 11/2004 | Howard |
| 7,445,435 | B2 | | 11/2008 | Howard |
| 7,775,776 | B2 | | 8/2010 | Bolding |
| 7,874,367 | B2 | | 1/2011 | Simmons |
| 7,927,083 | B2 | | 4/2011 | Simmons |
| 7,967,578 | B2 | | 6/2011 | McNichol et al. |
| 7,984,756 | B2 | | 7/2011 | Dowling et al. |
| 8,011,901 | B2 | | 9/2011 | Duncan |
| 8,360,751 | B2 | | 1/2013 | Duncan |
| 8,454,325 | B2 | | 6/2013 | Fisher et al. |
| 8,523,542 | B2 | | 9/2013 | Hofstatter |
| 8,535,017 | B2 | | 9/2013 | McNichol et al. |
| 8,573,309 | B2 | | 11/2013 | Simmons |
| 8,932,030 | B2 | | 1/2015 | McNichol et al. |
| 8,991,504 | B2 | | 3/2015 | Hansen |
| 10,280,727 | B2 | | 5/2019 | Saponja et al. |
| 2009/0321084 | A1 | | 12/2009 | Simmons |
| 2015/0267519 | A1 | | 9/2015 | Saponja et al. |
| 2016/0102536 | A1 | | 4/2016 | Knoeller |
| 2018/0283155 | A1 | | 10/2018 | Saponja et al. |
| 2019/0048695 | A1 | | 2/2019 | Hansen et al. |
| 2019/0195059 | A1 | | 6/2019 | Hrupp |

OTHER PUBLICATIONS

HEAL Systems LLP—"HEAL System: Where does the flow go?" www.healsystems.com, 2018, 1 page.

Langbauer, C., et al. - "Hydraulic Concentric Tubular Pumping System for Lifting Oil in EOR Completions," SPE-190344-MS, paper prepared for presentation at the SPE-EOR Conference at Oil and Gas West Asia held in Muscat, Oman, Mar. 26-28, 2018, 12 pages.

Petrowiki—"Hydraulic pumping," https://petrowiki.org/Hydraulic_pumping, last modified on Feb. 4, 2016, 16 pages.

Presley, Jennifer—"Selecting the Right Technology is Vital in Horizontal Wells," May 2012 Exclusive Story, The American Oil & Gas Reporter, Feb. 18, 2020, 7 pages.

International Search Report and Written Opinion dated Feb. 2, 2021 for Application No. PCT/US20/47983.

International Invitation to Pay Additional Fees and, Where Applicable, Protest Fee dated Dec. 4, 2020 for Application No. PCT/US2020/047983.

* cited by examiner

METHOD AND APPARATUS FOR PRODUCING WELL FLUIDS

CROSS-REFERENCE TO RELATED APPLICATIONS

This application claims benefit of U.S. provisional patent application Ser. No. 62/893,090, filed Aug. 28, 2019 and U.S. provisional patent application Ser. No. 63/026,548, filed May 18, 2020, both of which are herein incorporated by reference in their entireties.

BACKGROUND

Field

Embodiments of the present disclosure generally relate to a pump that can be installed in a wellbore, and methods of using a pump to assist in the production of fluids from a wellbore.

Description of the Related Art

The production of fluids from a wellbore may involve using a downhole pump that is installed within the wellbore. Some types of downhole pump are driven by an electric motor located within the wellbore. Such pumps typically contain many successive pump stages, each stage connected to central shaft that is rotated at high speed by the electric motor. Such pumps, therefore, are relatively long and thus may be unsuitable for use in wellbores that are curved because the high speed rotation of a curved shaft may cause issues with fatigue and wear. Additionally, the electric motors of such pumps are prone to suffer issues with the longevity of electrical insulation and with the effective dissipation of heat during operation.

Other types of downhole pump are driven by a mechanical linkage connected to a driver at surface. One example is a so-called rod lift pump that has a rod extending from surface into the wellbore and down to the pump. The rod is manipulated by a pumpjack at surface such that the rod reciprocates axially. Downhole, the rod is connected to a pump, and the reciprocal motion of the rod causes the pump to lift an incremental volume of fluid with each reciprocation. Such pump systems may also be unsuitable for curved wellbores because wellbore curvature causes the rods to rub against the wellbore tubulars, leading to wear of the rods and wear of the tubulars. Additionally, the friction between the rods and the wellbore tubulars is a source of inefficiency that limits the depth and deviation angle of wellbores at which such pumps may be effectively operated. Therefore, such pumps may be unsuitable for installation at, or close to, a producing zone of a highly deviated, or horizontal, wellbore.

There is a need for a downhole pump for use in wellbores, particularly curved wellbores, horizontal wellbores, and deep wellbores, that does not suffer from the above limitations.

SUMMARY

In one embodiment, a pump includes a drive chamber, a production chamber, and a piston assembly. The piston assembly includes a drive piston axially movable within the drive chamber, a production piston axially movable with the production chamber, and a tube coupling the drive piston with the production piston. The piston assembly further includes a first traveling valve axially separated from a second traveling valve.

In another embodiment, a method of operating a pump in a wellbore includes applying a pressure to a drive piston in a drive chamber, thereby moving the drive piston in a first direction and thereby moving a production piston in the first direction. The method further includes causing a first traveling valve associated with the production piston to close and causing a second traveling valve above the first traveling valve to open.

In another embodiment, a method of producing fluid from a wellbore includes operating a pump located proximate to a zone of fluid influx in the wellbore to draw a reservoir fluid from a reservoir into the wellbore at the zone of fluid influx. The pump is coupled to a tubing string extending above the pump, and a packer is coupled to the tubing string proximate to an upper end of the zone of fluid influx and seals an annular space around the tubing string. The method includes operating the pump to produce the reservoir fluid from the wellbore through the tubing string.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure relates to a pump for installation and use in a wellbore, and particularly to a pump that is driven by the successive application and release of hydraulic pressure via a power fluid. The present disclosure relates also to methods of operating such a pump to produce fluids from a wellbore. The present disclosure relates also to configurations in which a pump may be installed and operated in a wellbore.

Figure 1:
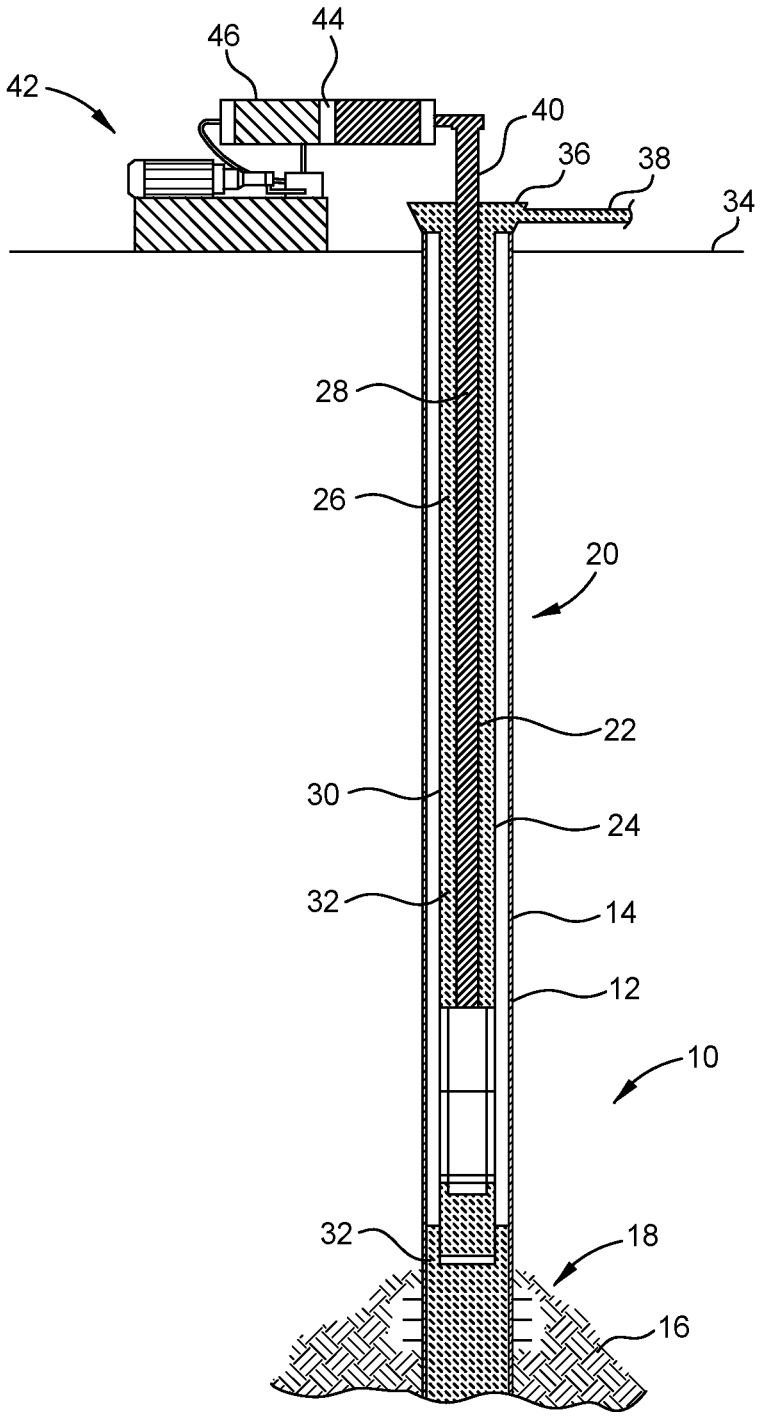
FIG. 1 is an overview of a system that includes a pump installed in a wellbore.

FIG. 1 is a schematic overview of a system that includes a pump 10 installed in a wellbore 12. For clarity, the wellbore 12 is shown as being vertical, but the wellbore 12 may be deviated, curved, or horizontal. The wellbore 12 is lined with a casing 14, and penetrates a geological formation 16. Reservoir fluids of the geological formation 16 may enter the wellbore 12 at a zone of fluid influx 18. A pump 10 is located in a lower part of the wellbore 12. The pump 10 may be located in a vertical, deviated, curved, or horizontal part of the wellbore 12. The pump 10 is coupled to a tubing string 20. In the illustrated embodiment, the tubing string 20 includes an inner tubular 22 and an outer tubular 24. In the illustrated embodiment, the inner tubular 22 may serve as a conduit (termed a "power fluid conduit" 26) for a power fluid 28, and the outer tubular 24 may serve as a conduit (termed a "produced fluid conduit" 30) for reservoir fluid 32 produced from the geological formation 16. In some embodiments, the inner tubular 22 may be a produced fluid conduit 30, and the outer tubular 24 may be a power fluid conduit 26. In some embodiments, the power fluid conduit 26 may be positioned side-by-side with the produced fluid conduit 30. In some embodiments, the power fluid conduit 26 may be a tubular having a smaller diameter than the produced fluid conduit 30. In some embodiments, the power fluid conduit 26 may be a capillary line.

In some embodiments, the tubing string 20 may be a single string of tubulars. The single string of tubulars may be a power fluid conduit 26, and an annulus between the tubing string 20 and the casing 14 may be a produced fluid conduit 30. Alternatively, the single string of tubulars may be a produced fluid conduit 30, and the annulus between the tubing string 20 and the casing 14 may be a power fluid conduit 26.

At the surface 34, a wellhead 36 may include an outlet 38 for the fluids that are produced from the geological formation 16. The wellhead 36 may have an inlet 40 for the power fluid 28. The power fluid inlet 40 may be connected to a pulsar unit 42. The pulsar unit 42 may include a piston 44 in a cylinder 46. The piston 44 may be operated to reciprocate in the cylinder 46 so as to repeatedly apply then release a pressure on the power fluid 28 that is contained in the power fluid conduit 26.

In some embodiments, the pressure applied on the power fluid 28 by the piston 44 may be 500 psi (approximately 34.5 bar) or greater. In some embodiments, the pressure applied on the power fluid 28 by the piston 44 may be 1,000 psi (approximately 69 bar) or greater. In some embodiments, the pressure applied on the power fluid 28 by the piston 44 may be 2,000 psi (approximately 138 bar) or greater. In some embodiments, the pressure applied on the power fluid 28 by the piston 44 may be 3,000 psi (approximately 207 bar) or greater. In some embodiments, the pressure applied on the power fluid 28 by the piston 44 may be from 4,000 to 5,000 psi (approximately 276 to 345 bar).

In some embodiments, the release of the pressure on the power fluid 28 may involve causing or allowing the magnitude of pressure applied on the power fluid 28 by the piston 44 to decrease to a value that is substantially atmospheric pressure. In some embodiments, the release of the pressure on the power fluid 28 may involve causing or allowing the magnitude of pressure applied on the power fluid 28 by the piston 44 to decrease to a value that is greater than atmospheric pressure. In some embodiments, the release of the pressure on the power fluid 28 may involve causing or allowing the magnitude of pressure applied on the power fluid 28 by the piston 44 to decrease to a value that is less than atmospheric pressure.

In operation, the repeated application then release of pressure exerted by the pulsar unit 42 on the power fluid 28 in the power fluid conduit 26 drives the pump 10. Fluids from the geological formation 16 move into the wellbore 12. Fluid in the wellbore 12 ("reservoir fluid" 32) becomes drawn into the pump 10, then expelled from the pump 10 into the produced fluid conduit 30. Continued operation of the pump 10 causes the reservoir fluid 32 to move up the produced fluid conduit 30 to the wellhead 36, and then out of the outlet 38.

Figure 2:
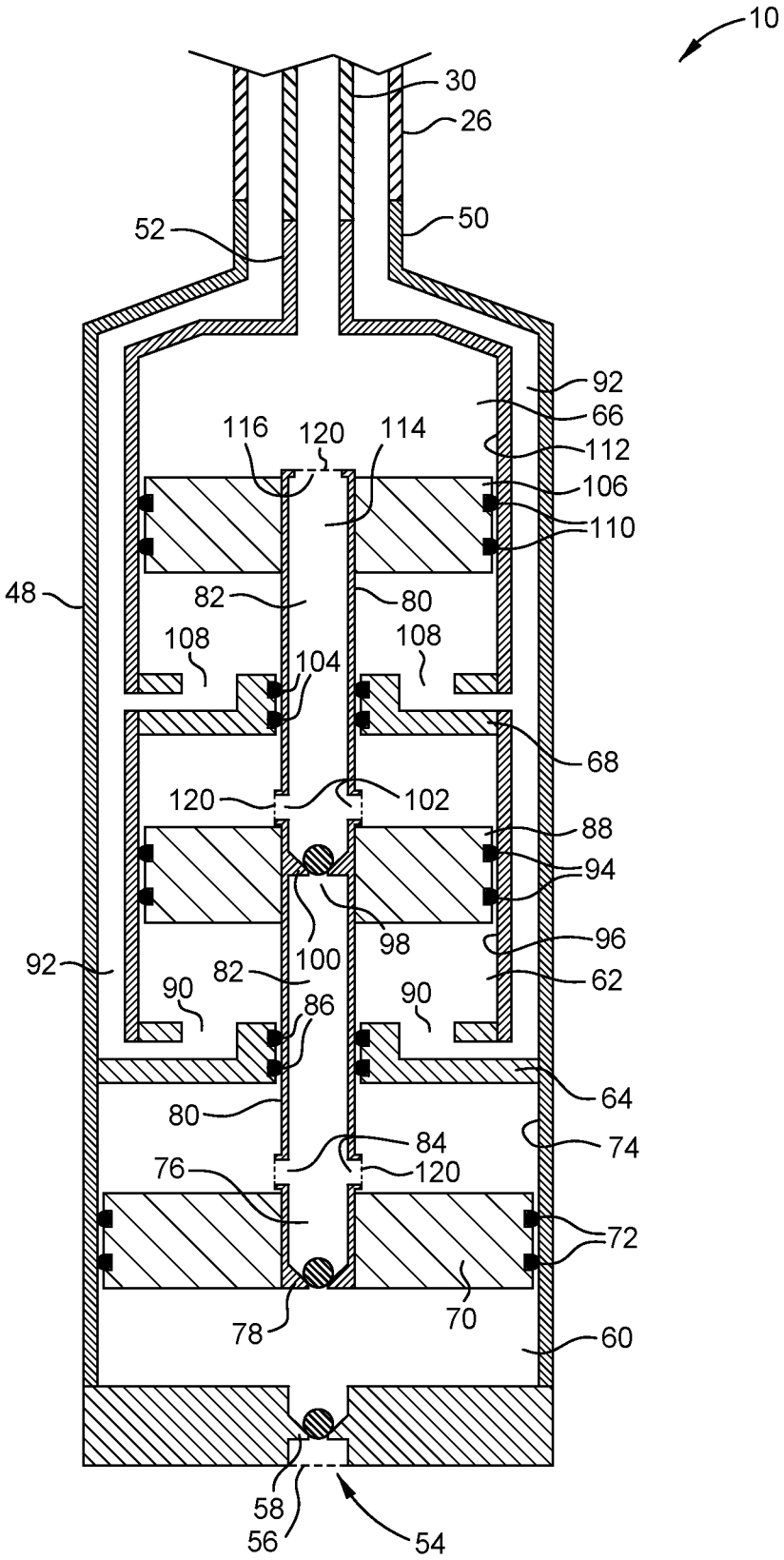
FIG. 2 is a schematic illustration of an embodiment of a pump of the present disclosure.

FIG. 2 is a schematic longitudinal cross-sectional view of a pump 10 that is suitable for installation and operation in a wellbore. The pump 10 may have a housing 48. The housing 48 may be tubular in shape. The housing 48 may have a connection 50 to a power fluid conduit 26. The housing 48 may have a connection 52 to a produced fluid conduit 30. In the embodiment shown in FIG. 2, the produced fluid conduit 30 is internal to the power fluid conduit 26. The housing 48 has a reservoir fluid inlet 54. In some embodiments, the housing 48 may have more than one reservoir fluid inlet 54. In some embodiments, the reservoir fluid inlet 54 may have a filter 56, such as a screen. The filter 56 may be configured to allow fluids to pass through the reservoir fluid inlet 54 but inhibit the passage of solid particles. The filter 56 may include a screen or mesh that is mounted on the outside of the housing 48 and across the reservoir fluid inlet 54. The filter 56 may include a screen or mesh that is mounted on the inside of the housing 48 and across the reservoir fluid inlet 54. The filter 56 may include a screen or mesh that is inserted into the reservoir fluid inlet 54. The reservoir fluid inlet 54 may include one or more narrow width opening through the wall of the housing 48 which may also serve as the filter 56. In some embodiments, the filter 56 may be omitted.

In some embodiments, the reservoir fluid inlet 54 may have a standing valve 58. The standing valve 58 may be configured to allow fluids to pass through the reservoir fluid inlet 54 into the pump 10 but inhibit the passage of fluids out of the pump 10 through the reservoir fluid inlet 54. In some embodiments, the reservoir fluid inlet 54 may have more than one standing valve 58. The plurality of standing valves 58 may be arranged in series such that fluid entering the pump 10 passes through each standing valve 58. In some embodiments, the standing valve 58 may be omitted, such that fluids may pass through the reservoir fluid inlet 54 into and out of the pump 10.

The housing 48 may have a production chamber 60. In some embodiments, the housing 48 may have a reset chamber 62 that is separated from the production chamber 60 by a first bulkhead 64. In some embodiments, the housing 48 may have a drive chamber 66. The drive chamber 66 may be separated from the reset chamber 62 by a second bulkhead 68. In some embodiments, the reset chamber 62 may be omitted, and the housing 48 may have a drive chamber 66 separated from the production chamber 60 by the first bulkhead 64. In some embodiments, the housing 48, bulkheads 64, 68, and chambers 60, 62, 66 may be modular such that a pump 10 may be configured with more than one drive chamber 66. In some embodiments, the housing 48, bulkheads 64, 68, and chambers 60, 62, 66 may be modular such that a pump 10 may be configured with more than one reset chamber 62. In some embodiments, the housing 48, bulkheads 64, 68, and chambers 60, 62, 66 may be modular such that a pump 10 may be configured with more than one production chamber 60.

A production piston 70 may be disposed in the production chamber 60. The production piston 70 may separate the production chamber 60 into upper and lower portions, and be axially movable within the production chamber 60 such that movement of the production piston 70 causes a volume of the upper portion of the production chamber 60 and a volume of the lower portion of the production chamber 60 to change. Thus, movement of the production piston 70 in a first direction may cause the volume of the upper portion of the production chamber 60 to decrease and the volume of the lower portion of the production chamber 60 to correspondingly increase. Similarly, movement of the production piston 70 in a second direction opposite to the first direction may cause the volume of the upper portion of the production chamber 60 to increase and the volume of the lower portion of the production chamber 60 to correspondingly decrease.

The production piston 70 may include a seal 72 in contact with an inner wall 74 of the production chamber 60. The production piston 70 may have a bore 76 that fluidically connects the lower portion of the production chamber 60 and the upper portion of the production chamber 60. A first traveling valve 78 may be associated with the bore 76. The first traveling valve 78 may be attached to the bore 76 of the production piston 70 such that it moves with the production piston 70. The first traveling valve 78 may be configured to allow passage of fluid from the lower portion of the production chamber 60 to the upper portion of the production chamber 60, but inhibit the passage of fluid from the upper portion of the production chamber 60 to the lower portion of the production chamber 60.

The production piston 70 may be coupled to a tube, such as transfer tube 80. The transfer tube 80 may be axially movable with the production piston 70. In some embodiments, the production piston 70 may be mounted around the transfer tube 80. In some embodiments, the production piston 70 may be mounted to the transfer tube 80 such that a bore 82 of the transfer tube 80 may be fluidically connected to the bore 76 of the production piston 70. The assembly of the transfer tube 80 and the production piston 70 may include a port 84 to allow fluid to transfer between the upper portion of the production chamber 60 and the bore 76 of the production piston 70 and/or the bore 82 of the transfer tube 80. The port 84 may be located above the first traveling valve 78. In some embodiments, a filter 120 may be associated with the port 84. The filter 120 may be configured to allow fluids to pass through the port 84, but inhibit the passage of solid particles through the port 84. The filter 120 may include a screen or mesh that is mounted on the outside of the transfer tube 80 and across the port 84. The filter 120 may include a screen or mesh that is mounted on the inside of the transfer tube 80 and across the port 84. The filter 120 may include a screen or mesh that is inserted into the port 84. The port 84 may include one or more narrow width opening through the wall of the transfer tube 80 which may also serve as the filter 120. In some embodiments, the filter 120 may be omitted. In some embodiments, the bore 82 of the transfer tube 80 may be fluidically connected to the bore 76 of the production piston 70 via the upper portion of the production chamber 60.

The upper portion of the production chamber 60 may be bounded by the first bulkhead 64. The transfer tube 80 may extend through the first bulkhead 64. One or more seals 86 may be included in order to prevent fluid from leaking through the first bulkhead 64 around the transfer tube 80. In embodiments in which the housing 48 has a reset chamber 62, the first bulkhead 64 may form a lower bound of the reset chamber 62. A reset piston 88 may be disposed in the reset chamber 62. The reset piston 88 may separate the reset chamber 62 into upper and lower portions, and be axially movable within the reset chamber 62 such that movement of the reset piston 88 causes a volume of the upper portion of the reset chamber 62 and a volume of the lower portion of the reset chamber 62 to change. Thus, movement of the reset piston 88 in a first direction may cause the volume of the upper portion of the reset chamber 62 to decrease and the volume of the lower portion of the reset chamber 62 to correspondingly increase. Similarly, movement of the reset piston 88 in a second direction opposite to the first direction may cause the volume of the upper portion of the reset chamber 62 to increase and the volume of the lower portion of the reset chamber 62 to correspondingly decrease.

The lower portion of the reset chamber 62 may have a port 90 that fluidically connects the lower portion of the reset chamber 62 with a power fluid passage 92. The power fluid passage 92 may be fluidically connected with the connection 50 to the power fluid conduit 26. In some embodiments, the power fluid passage 92 may be an annular passage. In some embodiments, the power fluid passage 92 may be located to one side of the housing 48.

The reset piston 88 may include a seal 94 in contact with an inner wall 96 of the reset chamber 62. The reset piston 88 may have a bore 98 from an upper side of the reset piston 88 to a lower side of the reset piston 88. The reset piston 88 may be coupled to the transfer tube 80, and may be movable with the transfer tube 80. In some embodiments, the transfer tube 80 may extend through the bore 98 of the reset piston 88. In some embodiments, the reset piston 88 may be mounted to the transfer tube 80 such that the bore 82 of the transfer tube 80 is fluidically connected with the bore 98 of the reset piston 88. A second traveling valve 100 may be associated with the assembly of the reset piston 88 and the transfer tube 80. The second traveling valve 100 may be movable with the reset piston 88. The second traveling valve 100 may be configured to allow passage of fluid within the transfer tube 80 from below the second traveling valve 100 to above the second traveling valve 100, but inhibit the passage of fluid from above the second traveling valve 100 to below the second traveling valve 100.

The transfer tube 80 may extend beyond an upper end of the reset piston 88. In some embodiments, the assembly of the transfer tube 80 and the reset piston 88 may include a port 102 to allow fluid to transfer between the upper portion of the reset chamber 62 and the bore 98 of the reset piston 88 and/or the bore 82 of the transfer tube 80. The port 102 may be located above the second traveling valve 100. In some embodiments, a filter 120 may be associated with the port 102. The filter 120 may be configured to allow fluids to pass through the port 102, but inhibit the passage of solid particles through the port 102. The filter 120 may include a screen or mesh that is mounted on the outside of the transfer tube 80 and across the port 102. The filter 120 may include a screen or mesh that is mounted on the inside of the transfer tube 80 and across the port 102. The filter 120 may include a screen or mesh that is inserted into the port 102. The port 102 may include one or more narrow width opening through the wall of the transfer tube 80 which may also serve as the filter 120. In some embodiments, the filter 120 may be omitted. In some embodiments, the bore 82 of the transfer tube 80 above the reset piston 88 may be fluidically connected to the bore 98 of the reset piston 88 via the upper portion of the reset chamber 62.

The upper portion of the reset chamber 62 may be bounded by the second bulkhead 68. The transfer tube 80 may extend through the second bulkhead 68. One or more seals 104 may be included in order to prevent fluid from leaking through the second bulkhead 68 around the transfer tube 80. In embodiments in which the housing 48 has a drive chamber 66, the second bulkhead 68 may form a lower bound of the drive chamber 66. A drive piston 106 may be disposed in the drive chamber 66. The drive piston 106 may separate the drive chamber 66 into upper and lower portions, and be axially movable within the drive chamber 66 such that movement of the drive piston 106 causes a volume of the upper portion of the drive chamber 66 and a volume of the lower portion of the drive chamber 66 to change. Thus, movement of the drive piston 106 in a first direction may cause the volume of the upper portion of the drive chamber 66 to decrease and the volume of the lower portion of the drive chamber 66 to correspondingly increase. Similarly, movement of the drive piston 106 in a second direction opposite to the first direction may cause the volume of the upper portion of the drive chamber 66 to increase and the volume of the lower portion of the drive chamber 66 to correspondingly decrease. The lower portion of the drive chamber 66 may have a port 108 that fluidically connects the lower portion of the drive chamber 66 with the power fluid passage 92.

The drive piston 106 may include a seal 110 in contact with an inner wall 112 of the drive chamber 66. The drive piston 106 may have a bore 114 from an upper side of the drive piston 106 to a lower side of the drive piston 106. The drive piston 106 may be coupled to the transfer tube 80, and may be movable with the transfer tube 80. In some embodiments, the transfer tube 80 may extend through the bore 114 of the drive piston 106. In some embodiments, the drive piston 106 may be mounted to the transfer tube 80 such that the bore 82 of the transfer tube 80 is fluidically connected with the bore 114 of the drive piston 106. A port 116 may allow fluid communication between the upper portion of the drive chamber 66 and the bore 82 of the transfer tube 80. The upper portion of the drive chamber 66 may be fluidically connected with the connection 52 to the produced fluid conduit 30. In some embodiments, a filter 120 may be associated with the port 116. The filter 120 may be configured to allow fluids to pass through the port 116, but inhibit the passage of solid particles through the port 116. The filter 120 may include a screen or mesh that is mounted on the outside of the transfer tube 80 and across the port 116. The filter 120 may include a screen or mesh that is mounted on the inside of the transfer tube 80 and across the port 116. The filter 120 may include a screen or mesh that is inserted into the port 116. The port 116 may include one or more narrow width opening through the wall of the transfer tube 80 which may also serve as the filter 120. In some embodiments, the filter 120 may be omitted.

The pump 10 may be modular, such that the pump 10 can include one or more drive chamber 66, each drive chamber 66 having a drive piston 106. The pump 10 can include one or more reset chamber 62, each reset chamber 62 having a reset piston 88. The pump 10 can include one or more production chamber 60, each production chamber 60 having a production piston 70. The drive piston 106, production piston 70, and transfer tube 80 may form a piston assembly. The piston assembly may include the reset piston 88. The piston assembly may include the first traveling valve 78. The piston assembly may include the second traveling valve 100. The piston assembly may include additional pistons according to the modular configurations of the pump 10. In operation, the piston assembly may be move axially as a unit within the pump 10.

Figure 3:
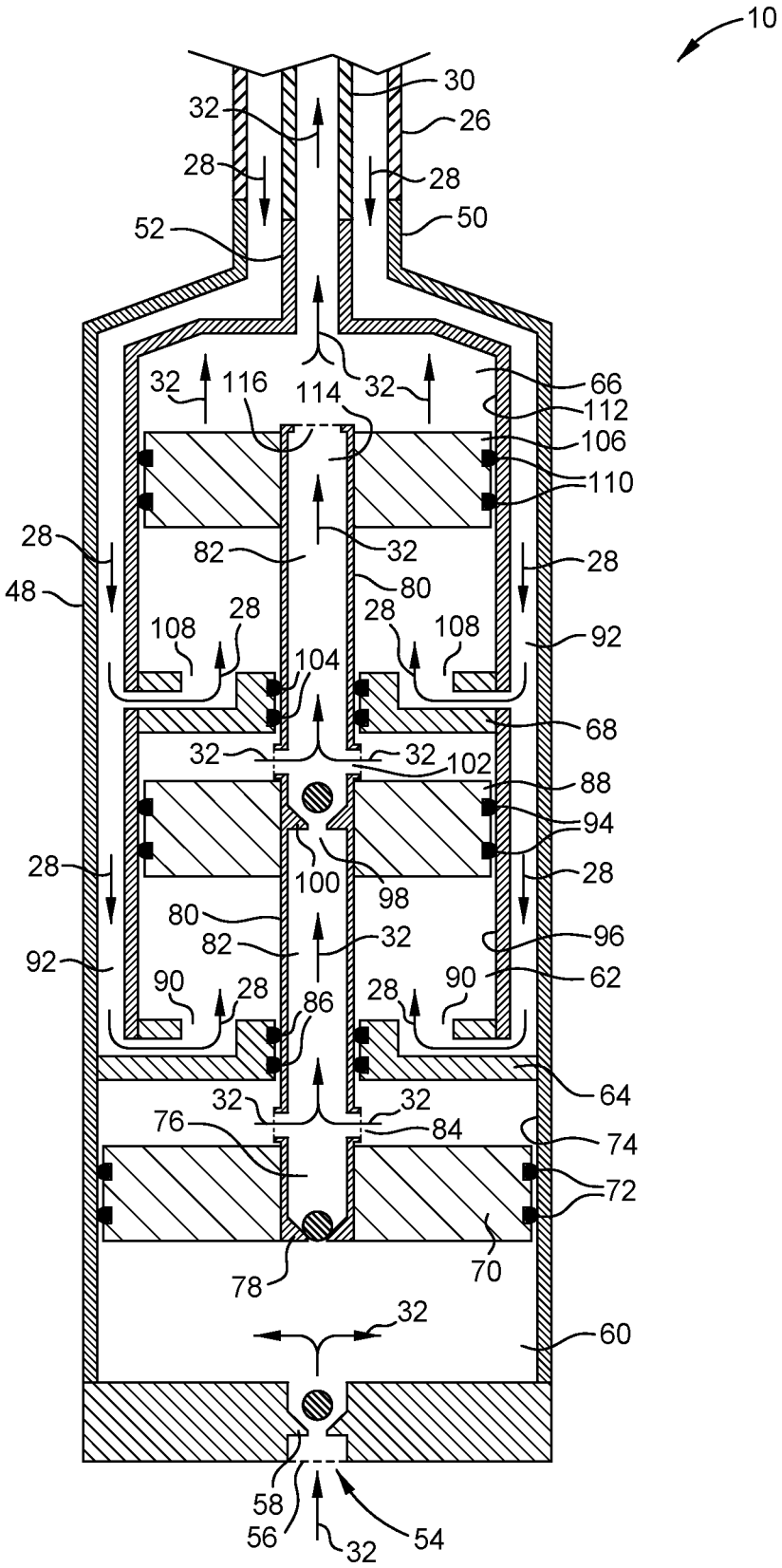
FIG. 3 is a schematic illustration of the embodiment of FIG. 2 during a first phase of operation.
Figure 4:
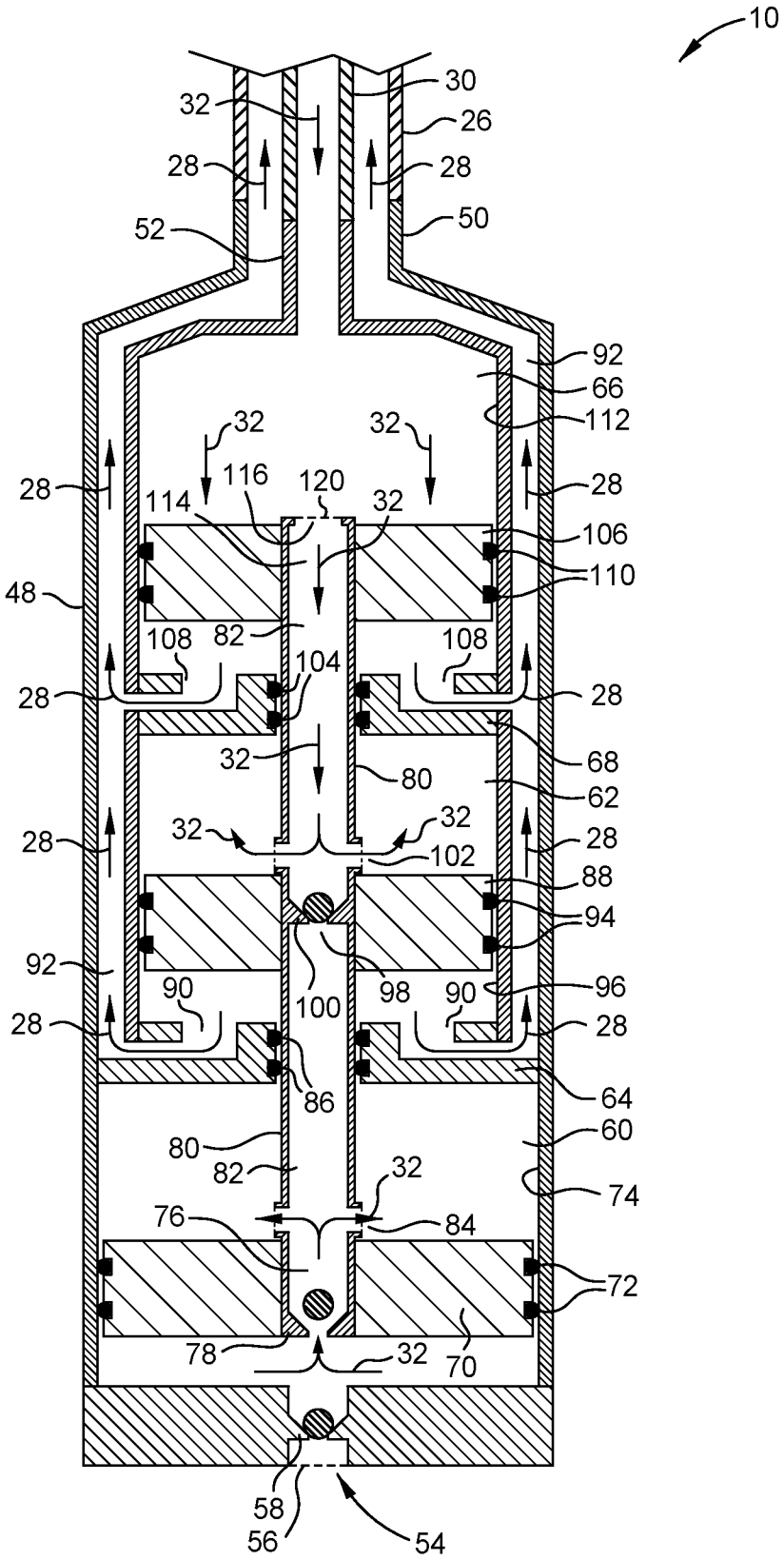
FIG. 4 is a schematic illustration of the embodiment of FIG. 2 during a second phase of operation.

FIGS. 3 and 4 are schematic longitudinal cross sections illustrating the operation of the pump 10 depicted in FIG. 2, and may be referred to in combination with FIG. 1. The pump 10 may be installed in a wellbore 12, and may be connected to a power fluid conduit 26 and a produced fluid conduit 30. The pump 10 may contain power fluid 28 in the power fluid passage 92, in the lower portion of the reset chamber 62, and in the lower portion of the drive chamber 66. The power fluid conduit 26 may contain a power fluid 28. The power fluid 28 may substantially fill the power fluid conduit 26 from the pump 10 to the surface 34. The power fluid 28 in the power fluid conduit 26 may be considered as a column of power fluid 28 that exerts a hydrostatic pressure ("hydrostatic head") on the power fluid 28 in the pump 10.

The pump 10 may contain reservoir fluid 32 in the production chamber 60, in the upper portion of the reset chamber 62, in the upper portion of the drive chamber 66, and in the transfer tube 80. The produced fluid conduit 30 may contain reservoir fluid 32. The column of fluid in the produced fluid conduit 30 may, or may not, extend from the pump 10 to the surface 34. The reservoir fluid 32 in the produced fluid conduit 30 may be considered as a column of reservoir fluid 32 that exerts a hydrostatic pressure ("hydrostatic head") on the reservoir fluid 32 in the pump 10.

In some embodiments, the power fluid 28 may have a density that is less than the density of the reservoir fluid 32. In some embodiments, the power fluid 28 may have a density that is substantially the same as the density of the reservoir fluid 32. In some embodiments, the power fluid 28 may include a hydrocarbon liquid. In some embodiments, the power fluid 28 may include water.

FIG. 3 shows the pump 10 in operation during a first phase. The first phase may be referred to as a production stroke. For the pump 10 of FIG. 2, the production stroke is an up stroke of the pistons 70, 88, and 106. During a production stroke, a pressure may be applied to the power fluid 28 in the power fluid conduit 26. The pressure may be applied by a pulsar unit 42 at the surface 34, and the power fluid 28 in the power fluid conduit 26 may communicate the applied pressure to the pump 10. The power fluid 28 may communicate the applied pressure to the power fluid 28 contained in the power fluid passage 92, and hence to the power fluid 28 in the lower portion of the reset chamber 62 through the port 90 and to the power fluid 28 in the lower portion of the drive chamber 66 through the port 108. Thus, the power fluid 28 in the power fluid passage 92, in the lower portion of the reset chamber 62, and in the lower portion of the drive chamber 66 experiences a pressure that is substantially equal to the magnitude of the pressure applied at surface 34 plus the hydrostatic head provided by the column of power fluid 28 in the power fluid conduit 26 from the surface 34 to the pump 10.

During a production stroke, a pressure may, or may not, be applied at the surface 34 to the reservoir fluid 32 in the produced fluid conduit 30. A pressure applied to the reservoir fluid 32 in the produced fluid conduit 30 may be in the form of a back pressure that is exerted due to the flow of reservoir fluid 32 through the wellhead outlet 38 and through associated valves and/or other restrictions. In some embodiments, effectively no pressure is applied at the surface 34 to the reservoir fluid 32 in the produced fluid conduit 30. In some embodiments, a pressure that is negligible in magnitude is applied at the surface 34 to the reservoir fluid 32 in the produced fluid conduit 30. When the reservoir fluid 32 is moving through the pump 10 and through the produced fluid conduit 30, the reservoir fluid 32 may experience a back pressure due to the flow of the reservoir fluid 32 through the pump 10 and through the produced fluid conduit 30. Thus, the reservoir fluid 32 contained within the upper portion of the drive chamber 66 and the upper portion of the reset chamber 62 experiences a pressure that is substantially equal to the magnitude of any pressure applied at surface 34 plus any flow-generated back pressure plus the hydrostatic head provided by the column of reservoir fluid 32 in the produced fluid conduit 30.

By appropriate selection of the composition and density of the power fluid 28, and appropriate selection of the magnitude of the pressure applied at the surface 34 to the column of power fluid 28 in the power fluid conduit 26, the pressure experienced by the power fluid 28 in the lower portion of the reset chamber 62 and in the lower portion of the drive chamber 66 may be greater than the pressure experienced by the reservoir fluid 32 in the upper portion of the reset chamber 62 and the upper portion of the drive chamber 66. Thus, the drive piston 106 and the reset piston 88 may experience a pressure imbalance that urges the drive piston 106 and the reset piston 88 upward.

Upward movement of the drive piston 106 reduces the volume of the upper portion of the drive chamber 66, and therefore forces at least a portion of the reservoir fluid 32 contained in the drive chamber 66 out through the connection 52 to the produced fluid conduit 30 and into the produced fluid conduit 30. Reservoir fluid 32 that is already in the produced fluid conduit 30 is thus moved upwards, and, with reference back to FIG. 1, reservoir fluid 32 at an upper end of the produced fluid conduit 30 is moved through the wellhead 36 and out through the outlet 38.

Upward movement of the reset piston 88 reduces the volume of the upper portion of the reset chamber 62, and therefore forces at least a portion of the reservoir fluid 32 contained in the reset chamber 62 through the port 102 and into the transfer tube 80.

In embodiments in which the transfer tube 80 couples the drive piston 106 with the reset piston 88, the drive piston 106 and the reset piston 88 may move in unison. As shown in FIG. 3, the transfer tube 80 couples the reset piston 88 with the production piston 70. Upward movement of the drive piston 106 coupled with the reset piston 88 causes upward movement of the production piston 70. Upward movement of the production piston 70 reduces the volume of the upper portion of the production chamber 60, and therefore forces at least a portion of the reservoir fluid 32 contained in the upper portion of the production chamber 60 through the port 84 and into the transfer tube 80.

Upward movement of the production piston 70 increases the volume of the lower portion of the production chamber 60, and therefore reduces the pressure of the reservoir fluid 32 contained within the lower portion of the production chamber 60. Since the pump 10 is in a wellbore 12, there is reservoir fluid 32 in the wellbore 12 outside the pump 10 in the vicinity of the reservoir fluid inlet 54. When the pressure of the reservoir fluid 32 in the wellbore 12 in the vicinity of the reservoir fluid inlet 54 exceeds the pressure of the reservoir fluid 32 contained within the lower portion of the production chamber 60 by a threshold magnitude, the standing valve 58 (if present) will open and continued upward movement of the production piston 70 may draw reservoir fluid 32 into the production chamber 60 through the reservoir fluid inlet 54.

The movement of reservoir fluid 32 into the pump 10 through the reservoir fluid inlet 54 may result in a localized reduction of pressure of the fluid in the wellbore 12 proximate to a zone of fluid influx 18 (FIG. 1). In some embodiments, the pressure in the wellbore 12 proximate to the zone of fluid influx 18 may be reduced to a magnitude less than the in situ pressure of the surrounding geological formation 16. Thus, there may be a drawdown pressure created that may provide a driving force to draw fluid contained within the surrounding geological formation 16 to flow toward, and into, the wellbore 12 at the zone of fluid influx 18. In some embodiments, the pressure in the wellbore 12 proximate to the zone of fluid influx 18 may be reduced to a magnitude that is, at least temporarily, significantly less than the in situ pressure of the surrounding geological formation 16. In some embodiments, the pressure in the wellbore 12 proximate to the zone of fluid influx 18 may be reduced to a magnitude that is, at least temporarily, substantially equal to atmospheric pressure. In some embodiments, the pressure in the wellbore 12 proximate to the zone of fluid influx 18 may be reduced to a magnitude that is, at least temporarily, less than atmospheric pressure.

Still referring to the upward movement of the production piston 70, the reduced pressure of the reservoir fluid 32 within the lower portion of the production chamber 60 and the forcing of reservoir fluid 32 out of the upper portion of the production chamber 60 into the transfer tube 80 results in the pressure of the reservoir fluid 32 in the transfer tube 80 at the first traveling valve 78 exceeding the pressure of the reservoir fluid 32 within the lower portion of the production chamber 60. Therefore, the first standing valve 58 will be held in a closed position, and will prevent fluid transfer between the transfer tube 80 and the lower portion of the production chamber 60. Thus, the reservoir fluid 32 that enters the transfer tube 80 through the through the port 84 travels upward through the transfer tube 80.

In the transfer tube 80, the second traveling valve 100 experiences a pressure from above derived at least in part from the pressure of the reservoir fluid 32 being moved out of the upper portion of the reset chamber 62. This fluid may travel relatively unhindered upward through the transfer tube 80, and be commingled with the reservoir fluid 32 within and moving out of the upper portion of the drive chamber 66 and into the produced fluid conduit 30. The second traveling valve 100 experiences a pressure from below derived at least in part from the pressure of the reservoir fluid 32 being moved out of the upper portion of the production chamber 60 and into the transfer tube 80. Because the standing valve 58 is closed, the only available flow path for this fluid is upward through the transfer tube 80. Continued upward movement of the production piston 70 forces more reservoir fluid 32 out of the upper portion of the production chamber 60 and into the transfer tube 80 toward the second traveling valve 100. Thus the pressure exerted by the reservoir fluid 32 in the transfer tube 80 below the second traveling valve 100 will increase until the pressure exerted by the reservoir fluid 32 in the transfer tube 80 below the second traveling valve 100 exceeds the pressure exerted by the reservoir fluid 32 in the transfer tube 80 above the second traveling valve 100 by a threshold value. At this point the second traveling valve 100 will open to allow the reservoir fluid 32 in the transfer tube 80 below the second traveling valve 100 to move through the second traveling valve 100 and commingle with the reservoir fluid 32 in the transfer tube 80 that is exiting the upper portion of the reset chamber 62.

Therefore, in summary, during a production stroke of the pistons 70, 88, and 106 in the pump 10, the standing valve 58 (if present) may open to allow reservoir fluid 32 into the lower portion of the production chamber 60, the first traveling valve 78 may close, the second traveling valve 100 may open, and reservoir fluid 32 in the upper portion of the production chamber 60 and in the upper portion of the reset chamber 62 may enter the transfer tube 80. Reservoir fluid 32 in the transfer tube 80 may flow out of the upper end of the transfer tube 80 and commingle with reservoir fluid 32 in the upper portion of the drive chamber 66. Reservoir fluid 32 in the upper portion of the drive chamber 66 may flow out of the pump 10 and into the produced fluid conduit 30. Additionally, reservoir fluid 32 may move upward through the produced fluid conduit 30, and reservoir fluid 32 may flow out of the produced fluid conduit 30 at the surface 34 and through the outlet 38 of the wellhead 36.

With the pump 10 as illustrated in FIG. 3, the transfer tube 80 is placed in axial tension during a production stroke by the action of the drive piston 106 and/or the reset piston 88 pulling the production piston 70. By being in axial tension rather than axial compression, the transfer tube 80 may be less susceptible to buckling. Hence, such a risk of buckling may not inhibit the effective configuration of the operating conditions for the production stroke. Thus, for example, a rate of travel of the pistons 70, 88, and 106 during the production stroke may be regulated as required to suit the desired operational circumstances for each wellbore 12. The enabling of such regulation may facilitate effective control of the rate at which fluids from the geological formation 16 move into the wellbore 12 and become drawn into the pump 10.

FIG. 4 illustrates operation of the pump 10 during a second phase. The second phase may be referred to as a reset stroke. For the pump 10 of FIG. 2, the reset stroke is a down stroke of the pistons 70, 88, and 106. A reset stroke may be initiated at the surface 34 by a release of pressure that had been applied to the power fluid 28 in the power fluid conduit 26 during the production stroke. The release of pressure may be performed by the pulsar unit 42, such as by reversing a movement of piston 44 in cylinder 46 (FIG. 1). The release of pressure may bring the magnitude of the pressure applied at surface 34 down to substantially equal atmospheric pressure. The release of pressure may bring the magnitude of the pressure applied at surface 34 down to a value that is above atmospheric pressure. The release of pressure may bring the magnitude of the pressure applied at surface 34 down to a value that is less than atmospheric pressure, in other words at least a partial vacuum.

The reduction of the pressure applied at surface 34 to the column of power fluid 28 in the power fluid conduit 26 results in a reduction of the pressure experienced by the power fluid 28 within the lower portion of the drive chamber 66 and the lower portion of the reset chamber 62. By appropriate selection of the power fluid 28, and particularly the density of the power fluid 28, the pressure of the power fluid 28 in the lower portion of the drive chamber 66 and in the lower portion of the reset chamber 62 will be less than the pressure of the reservoir fluid 32 within the upper portion of the drive chamber 66 and in the upper portion of the reset chamber 62, respectively. Additionally, or alternatively, a pressure may be applied at surface 34 to the reservoir fluid 32 in the production conduit. Hence, the drive piston 106 and the reset piston 88 may experience pressure imbalances that cause the drive piston 106 and the reset piston 88 to move downward.

Downward movement of the reset piston 88 results in reservoir fluid 32 within the upper portion of the drive chamber 66 being drawn into the upper portion of the reset chamber 62 through the transfer tube 80 and port 102. Downward movement of the drive piston 106 results in reservoir fluid 32 within the produced fluid conduit 30 being drawn into the upper portion of the drive chamber 66. Downward movement of the drive piston 106 and the reset piston 88 also results in power fluid 28 being forced out of the lower portion of the drive chamber 66 and the lower portion of the reset chamber 62, respectively, and into the power fluid passage 92. Power fluid 28 in the power fluid passage 92 may be forced into the power fluid conduit 26.

Downward movement of the drive piston 106 and the reset piston 88 also causes downward movement of the production piston 70 because of the coupling between the pistons provided by the transfer tube 80. Downward movement of the production piston 70 results in enlargement of the upper portion of the production chamber 60, which causes a localized reduction in pressure.

Because of the port 84, this reduction in pressure is also experienced by the reservoir fluid 32 in the portion of the transfer tube 80 between the first traveling valve 78 and the second traveling valve 100. The pressure the reservoir fluid 32 will be substantially equal to the full hydrostatic head of the column of the reservoir fluid 32 in the produced fluid conduit 30, and hence the pressure of the reservoir fluid 32 below the second traveling valve 100 will become less than the pressure of the reservoir fluid 32 above the second traveling valve 100. Thus, the second traveling valve 100 will close, thereby preventing passage of fluid therethrough.

Downward movement of the production piston 70 also reduces the size of the lower portion of the production chamber 60, which causes therein a localized increase in pressure. When the pressure of the reservoir fluid 32 in the lower portion of the production chamber 60 exceeds the pressure of the reservoir fluid 32 above the first traveling valve 78 by a threshold magnitude, the first traveling valve 78 will open, thereby allowing reservoir fluid 32 to flow from the lower portion of the production chamber 60 into the transfer tube 80 and through the port 84 into the upper portion of the production chamber 60. Additionally, the increased pressure in the lower portion of the production chamber 60 will cause the standing valve 58 (if present) to close, thereby preventing reservoir fluid 32 from transferring between the lower portion of the production chamber 60 and the exterior of the pump 10.

Therefore, in summary, during a reset stroke of the pistons 70, 88, and 106 in the pump 10, the standing valve 58 (if present) may close to prevent reservoir fluid 32 in the lower portion of the production chamber 60 from exiting the pump 10 through the reservoir fluid inlet 54. Additionally, the first traveling valve 78 may open, the second traveling valve 100 may close, and reservoir fluid 32 in the lower portion of the production chamber 60 may flow into the upper portion of the production chamber 60. Some reservoir fluid 32 in the transfer tube 80 below the second traveling valve 100 may also flow into the upper portion of the production chamber 60. Some reservoir fluid 32 in the produced fluid conduit 30 may flow back into the upper portion of the drive chamber 66, and may flow through the portion of the transfer tube 80 above the second traveling valve 100 into the upper portion of the reset chamber 62. Furthermore, some power fluid 28 in the lower portion of the drive chamber 66 and the lower portion of the reset chamber 62 may flow into the power fluid passage 92, and may flow into the power fluid conduit 26.

Pump 10 operation continues as described above with a repeated sequence of a production stroke followed by a reset stroke. Thus, reciprocal action of the pistons of the pump 10 results in the production of reservoir fluid 32 to the surface 34. Because pump 10 operates by the sequential drawing and expelling of reservoir fluid 32 into and out of the production chamber 60 by production piston 70, pump 10 may be considered as a positive displacement pump.

Figure 5:
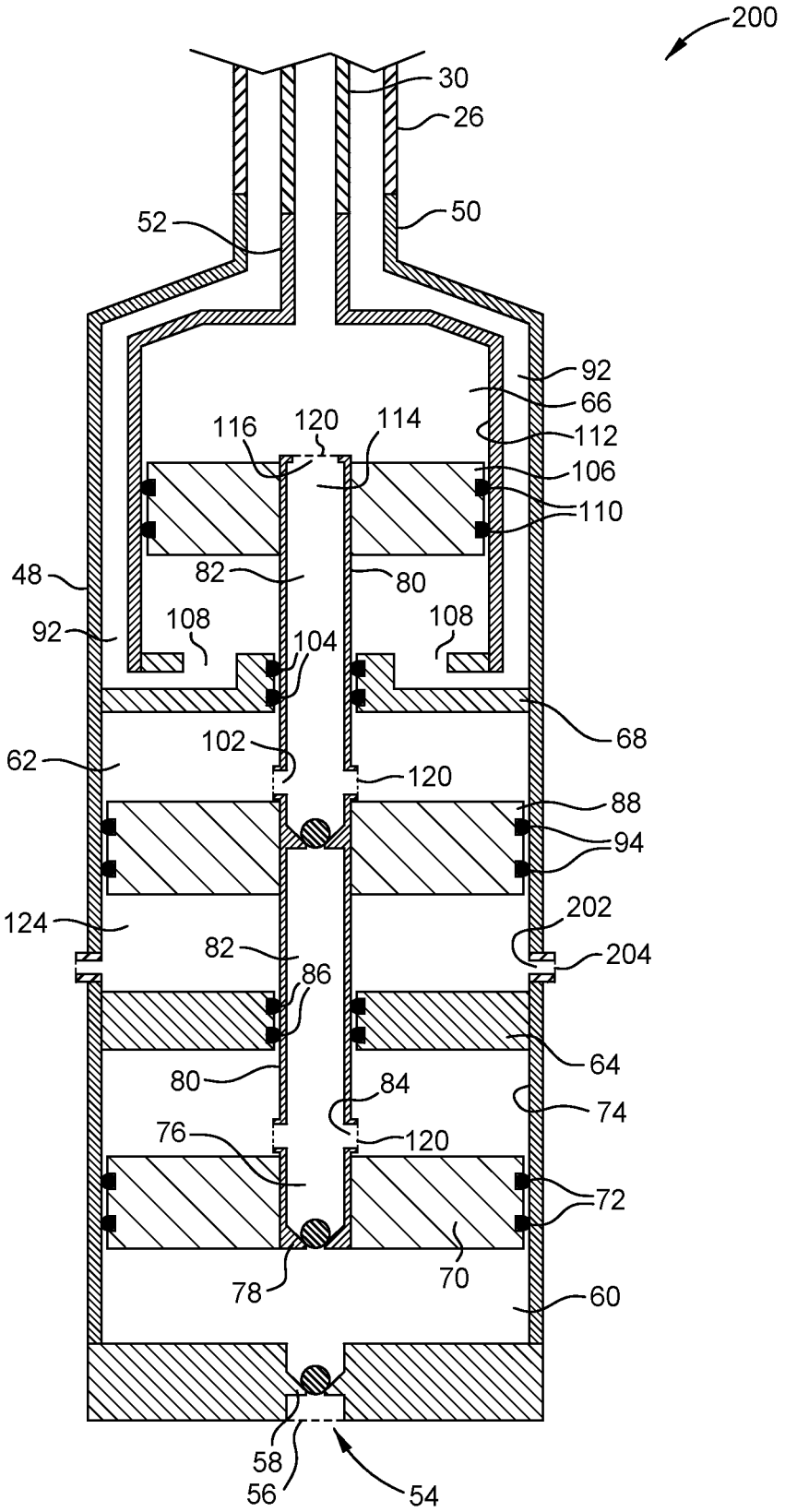
FIG. 5 is a schematic illustration of an embodiment of a pump of the present disclosure.

FIG. 5 is a schematic longitudinal cross-sectional view of a pump 200 that is suitable for installation and operation in a wellbore. The pump 200 is an alternative configuration of pump 10 that may be used in place of pump 10. Components that are common to pumps 10 and 200 retain the reference numerals used in the description of the pump 10. The pump 200 may have a housing 48. The housing 48 may be tubular in shape. The housing 48 may have a connection 50 to a power fluid conduit 26. The housing 48 may have a connection 52 to a produced fluid conduit 30. In the embodiment shown in FIG. 5, the produced fluid conduit 30 is internal to the power fluid conduit 26. The housing 48 has a reservoir fluid inlet 54. In some embodiments, the housing 48 may have more than one reservoir fluid inlet 54. In some embodiments, the reservoir fluid inlet 54 may have a filter 56, such as a screen. The filter 56 may be configured to allow fluids to pass through the reservoir fluid inlet 54 but inhibit the passage of solid particles. The filter 56 may include a screen or mesh that is mounted on the outside of the housing 48 and across the reservoir fluid inlet 54. The filter 56 may include a screen or mesh that is mounted on the inside of the housing 48 and across the reservoir fluid inlet 54. The filter 56 may include a screen or mesh that is inserted into the reservoir fluid inlet 54. The reservoir fluid inlet 54 may include one or more narrow width opening through the wall of the housing 48 which may also serve as the filter 56. In some embodiments, the filter 56 may be omitted.

In some embodiments, the reservoir fluid inlet 54 may have a standing valve 58. The standing valve 58 may be configured to allow fluids to pass through the reservoir fluid inlet 54 into the pump 200 but inhibit the passage of fluids out of the pump 200 through the reservoir fluid inlet 54. In some embodiments, the reservoir fluid inlet 54 may have more than one standing valve 58. The plurality of standing valves 58 may be arranged in series such that fluid entering the pump 200 passes through each standing valve 58. In some embodiments, the standing valve 58 may be omitted, such that fluids may pass through the reservoir fluid inlet 54 into and out of the pump 200.

The housing 48 may have a production chamber 60. In some embodiments, the housing 48 may have a reset chamber 62 that is separated from the production chamber 60 by a first bulkhead 64. In some embodiments, the housing 48 may have a drive chamber 66. The drive chamber 66 may be separated from the reset chamber 62 by a second bulkhead 68. In some embodiments, the housing 48, bulkheads 64, 68, and chambers 60, 62, 66 may be modular such that a pump 200 may be configured with more than one drive chamber 66. In some embodiments, the housing 48, bulkheads 64, 68, and chambers 60, 62, 66 may be modular such that a pump 200 may be configured with more than one reset chamber 62. In some embodiments, the housing 48, bulkheads 64, 68, and chambers 60, 62, 66 may be modular such that a pump 200 may be configured with more than one production chamber 60.

A production piston 70 may be disposed in the production chamber 60. The production piston 70 may separate the production chamber 60 into upper and lower portions, and be axially movable within the production chamber 60 such that movement of the production piston 70 causes a volume of the upper portion of the production chamber 60 and a volume of the lower portion of the production chamber 60 to change. Thus, movement of the production piston 70 in a first direction may cause the volume of the upper portion of the production chamber 60 to decrease and the volume of the lower portion of the production chamber 60 to correspondingly increase. Similarly, movement of the production piston 70 in a second direction opposite to the first direction may cause the volume of the upper portion of the production chamber 60 to increase and the volume of the lower portion of the production chamber 60 to correspondingly decrease.

The production piston 70 may include a seal 72 in contact with an inner wall 74 of the production chamber 60. The production piston 70 may have a bore 76 that fluidically connects the lower portion of the production chamber 60 and the upper portion of the production chamber 60. A first traveling valve 78 may be associated with the bore 76. The first traveling valve 78 may be attached to the bore 76 of the production piston 70 such that it moves with the production piston 70. The first traveling valve 78 may be configured to allow passage of fluid from the lower portion of the production chamber 60 to the upper portion of the production chamber 60, but inhibit the passage of fluid from the upper portion of the production chamber 60 to the lower portion of the production chamber 60.

The production piston 70 may be coupled to a tube, such as transfer tube 80. The transfer tube 80 may be axially movable with the production piston 70. In some embodiments, the production piston 70 may be mounted around the transfer tube 80. In some embodiments, the production piston 70 may be mounted to the transfer tube 80 such that a bore 82 of the transfer tube 80 is fluidically connected to the bore 76 of the production piston 70. The assembly of the transfer tube 80 and the production piston 70 may include a port 84 to allow fluid to transfer between the upper portion of the production chamber 60 and the bore 76 of the production piston 70 and/or the bore 82 of the transfer tube 80. The port 84 may be located above the first traveling valve 78. In some embodiments, a filter 120 may be associated with the port 84. The filter 120 may be configured to allow fluids to pass through the port 84, but inhibit the passage of solid particles through the port 84. The filter 120 may include a screen or mesh that is mounted on the outside of the transfer tube 80 and across the port 84. The filter 120 may include a screen or mesh that is mounted on the inside of the transfer tube 80 and across the port 84. The filter 120 may include a screen or mesh that is inserted into the port 84. The port 84 may include one or more narrow width opening through the wall of the transfer tube 80 which may also serve as the filter 120. In some embodiments, the filter 120 may be omitted. In some embodiments, the bore 82 of the transfer tube 80 may be fluidically connected to the bore 76 of the production piston 70 via the upper portion of the production chamber 60.

The upper portion of the production chamber 60 may be bounded by the first bulkhead 64. The transfer tube 80 may extend through the first bulkhead 64. One or more seals 86 may be included in order to prevent fluid from leaking through the first bulkhead 64 around the transfer tube 80. In embodiments in which the housing 48 has a reset chamber 62, the first bulkhead 64 may form a lower bound of the reset chamber 62. A reset piston 88 may be disposed in the reset chamber 62. The reset piston 88 may separate the reset chamber 62 into upper and lower portions, and be axially movable within the reset chamber 62 such that movement of the reset piston 88 causes a volume of the upper portion of the reset chamber 62 and a volume of the lower portion of the reset chamber 62 to change. Thus, movement of the reset piston 88 in a first direction may cause the volume of the upper portion of the reset chamber 62 to decrease and the volume of the lower portion of the reset chamber 62 to correspondingly increase. Similarly, movement of the reset piston 88 in a second direction opposite to the first direction may cause the volume of the upper portion of the reset chamber 62 to increase and the volume of the lower portion of the reset chamber 62 to correspondingly decrease.

The lower portion of the reset chamber 62 may have a port 202 that penetrates the housing 48 and fluidically connects the lower portion of the reset chamber 62 with an exterior of the pump 200. The port 202 may have a filter 204 that is configured to permit passage of fluid through the port 202, but inhibit passage of solid particles through the port 202. The filter 204 may include a screen or mesh that is mounted on the outside of the port 202. The filter 204 may include a screen or mesh that is mounted on the inside of the port 202. The filter 204 may include a screen or mesh that is inserted into the port 202. The port 202 may include one or more narrow width opening through the wall of the housing 48 which may also serve as the filter 204. In some embodiments, the filter 204 may be omitted.

The reset piston 88 may include a seal 94 in contact with an inner wall 96 of the reset chamber 62. The reset piston 88 may have a bore 98 from an upper side of the reset piston 88 to a lower side of the reset piston 88. The reset piston 88 may be coupled to the transfer tube 80, and may be movable with the transfer tube 80. In some embodiments, the transfer tube 80 may extend through the bore 98 of the reset piston 88. In some embodiments, the reset piston 88 may be mounted to the transfer tube 80 such that the bore 82 of the transfer tube 80 is fluidically connected with the bore 98 of the reset piston 88. A second traveling valve 100 may be associated with the assembly of the reset piston 88 and the transfer tube 80. The second traveling valve 100 may be movable with the reset piston 88. The second traveling valve 100 may be configured to allow passage of fluid within the transfer tube 80 from below the second traveling valve 100 to above the second traveling valve 100, but inhibit the passage of fluid from above the second traveling valve 100 to below the second traveling valve 100.

The transfer tube 80 may extend beyond an upper end of the reset piston 88. In some embodiments, the assembly of the transfer tube 80 and the reset piston 88 may include a port 102 to allow fluid to transfer between the upper portion of the reset chamber 62 and the bore 98 of the reset piston 88 and/or the bore 82 of the transfer tube 80. The port 102 may be located above the second traveling valve 100. In some embodiments, a filter 120 may be associated with the port 102. The filter 120 may be configured to allow fluids to pass through the port 102, but inhibit the passage of solid particles through the port 102. The filter 120 may include a screen or mesh that is mounted on the outside of the transfer tube 80 and across the port 102. The filter 120 may include a screen or mesh that is mounted on the inside of the transfer tube 80 and across the port 102. The filter 120 may include a screen or mesh that is inserted into the port 102. The port 102 may include one or more narrow width opening through the wall of the transfer tube 80 which may also serve as the filter 120. In some embodiments, the filter 120 may be omitted. In some embodiments, the bore 82 of the transfer tube 80 above the reset piston 88 may be fluidically connected to the bore 98 of the reset piston 88 via the upper portion of the reset chamber 62.

The upper portion of the reset chamber 62 may be bounded by the second bulkhead 68. The transfer tube 80 may extend through the second bulkhead 68. One or more seals 104 may be included in order to prevent fluid from leaking through the second bulkhead 68 around the transfer tube 80. In embodiments in which the housing 48 has a drive chamber 66, the second bulkhead 68 may form a lower bound of the drive chamber 66. A drive piston 106 may be disposed in the drive chamber 66. The drive piston 106 may separate the drive chamber 66 into upper and lower portions, and be axially movable within the drive chamber 66 such that movement of the drive piston 106 causes a volume of the upper portion of the drive chamber 66 and a volume of the lower portion of the drive chamber 66 to change. Thus, movement of the drive piston 106 in a first direction may cause the volume of the upper portion of the drive chamber 66 to decrease and the volume of the lower portion of the drive chamber 66 to correspondingly increase. Similarly, movement of the drive piston 106 in a second direction opposite to the first direction may cause the volume of the upper portion of the drive chamber 66 to increase and the volume of the lower portion of the drive chamber 66 to correspondingly decrease. The lower portion of the drive chamber 66 may have a port 108 that fluidically connects the lower portion of the drive chamber 66 with the power fluid passage 92.

The drive piston 106 may include a seal 110 in contact with an inner wall 112 of the drive chamber 66. The drive piston 106 may have a bore 114 from an upper side of the drive piston 106 to a lower side of the drive piston 106. The drive piston 106 may be coupled to the transfer tube 80, and may be movable with the transfer tube 80. In some embodiments, the transfer tube 80 may extend through the bore 114 of the drive piston 106. In some embodiments, the drive piston 106 may be mounted to the transfer tube 80 such that the bore 82 of the transfer tube 80 is fluidically connected with the bore 114 of the drive piston 106. A port 116 may allow fluid communication between the upper portion of the drive chamber 66 and the bore 82 of the transfer tube 80. The upper portion of the drive chamber 66 may be fluidically connected with the connection 52 to the produced fluid conduit 30. In some embodiments, a filter 120 may be associated with the port 116. The filter 120 may be configured to allow fluids to pass through the port 116, but inhibit the passage of solid particles through the port 116. The filter 120 may include a screen or mesh that is mounted on the outside of the transfer tube 80 and across the port 116. The filter 120 may include a screen or mesh that is mounted on the inside of the transfer tube 80 and across the port 116. The filter 120 may include a screen or mesh that is inserted into the port 116. The port 116 may include one or more narrow width opening through the wall of the transfer tube 80 which may also serve as the filter 120. In some embodiments, the filter 120 may be omitted.

The pump 200 may be modular, such that the pump 200 can include one or more drive chamber 66, each drive chamber 66 having a drive piston 106. The pump 200 can include one or more reset chamber 62, each reset chamber 62 having a reset piston 88. The pump 200 can include one or more production chamber 60, each production chamber 60 having a production piston 70. The drive piston 106, production piston 70, and transfer tube 80 may form a piston assembly. The piston assembly may include the reset piston 88. The piston assembly may include the first traveling valve 78. The piston assembly may include the second traveling valve 100. The piston assembly may include additional pistons according to the modular configurations of the pump 200. In operation, the piston assembly may be move axially as a unit within the pump 200.

Figure 6:
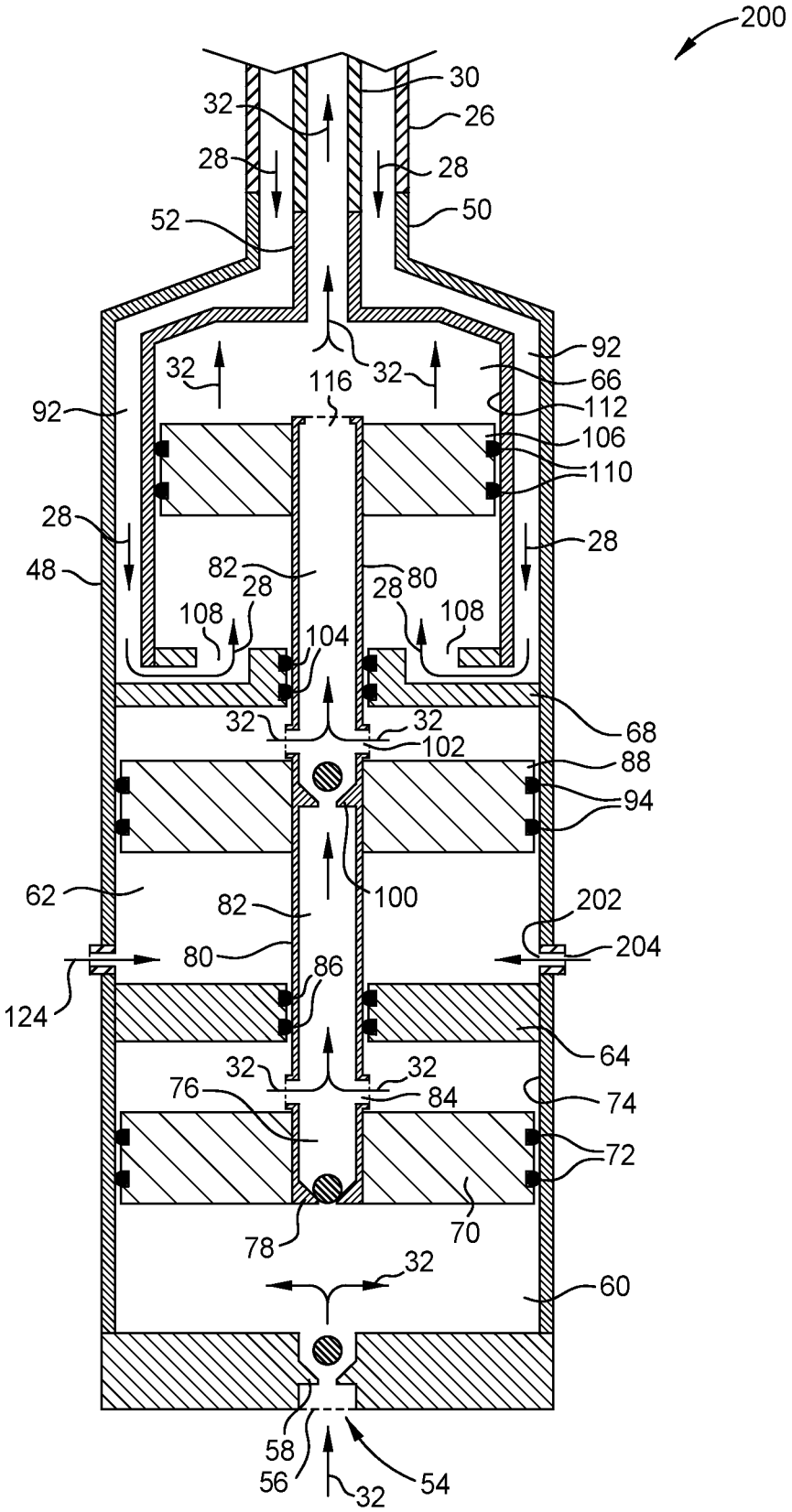
FIG. 6 is a schematic illustration of the embodiment of FIG. 5 during a first phase of operation.
Figure 7:
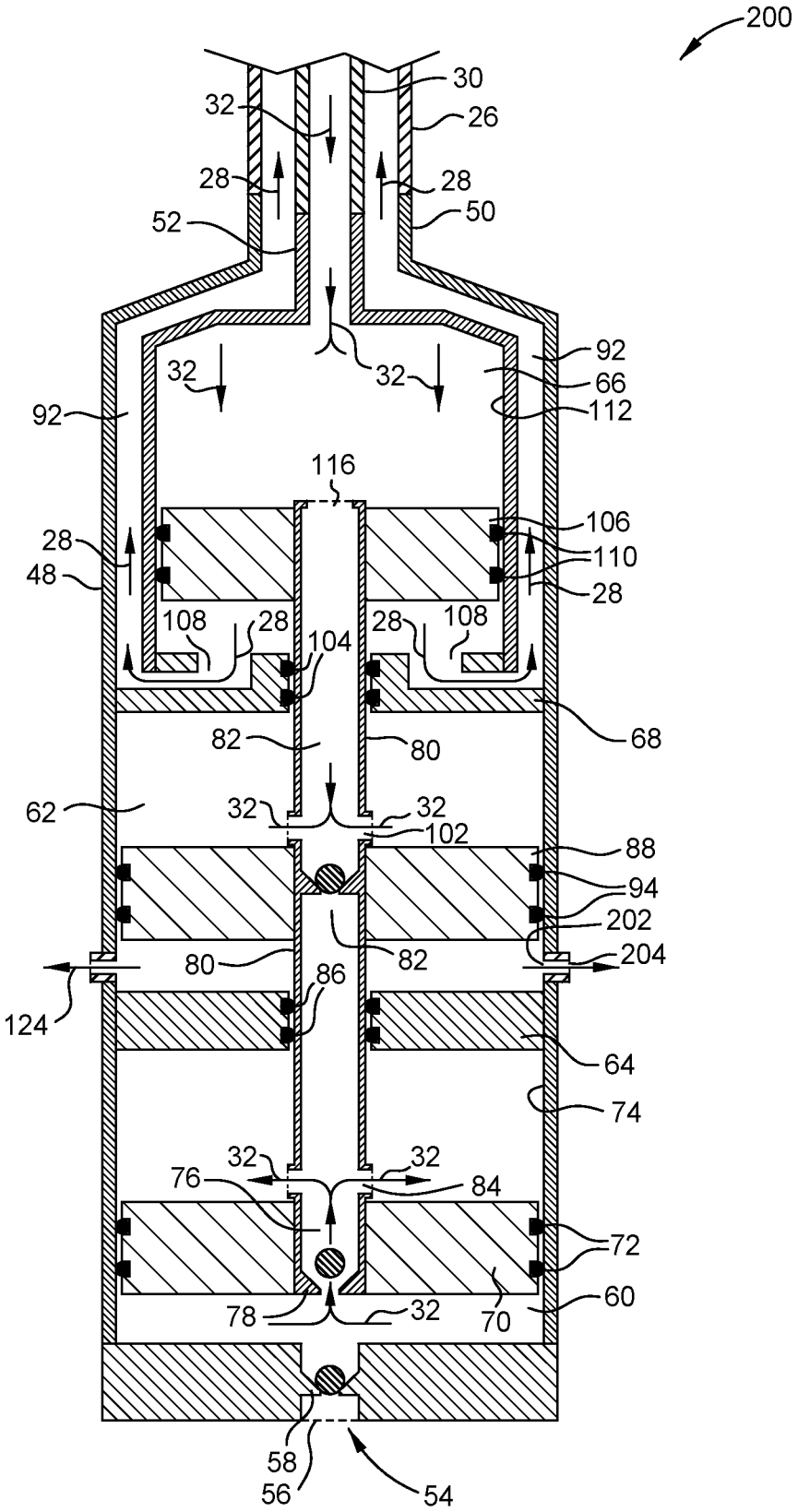
FIG. 7 is a schematic illustration of the embodiment of FIG. 5 during a second phase of operation.

FIGS. 6 and 7 are schematic longitudinal cross sections illustrating the operation of the pump 200 depicted in FIG. 5, and may be referred to in combination with FIG. 1. The pump 200 may be installed in place of pump 10 in a wellbore 12, and may be connected to a power fluid conduit 26 and a produced fluid conduit 30. The pump 200 may contain power fluid 28 in the power fluid passage 92 and in the lower portion of the drive chamber 66. The power fluid conduit 26 may contain a power fluid 28. The power fluid 28 may substantially fill the power fluid conduit 26 from the pump 200 to the surface 34. The power fluid 28 in the power fluid conduit 26 may be considered as a column of power fluid 28 that exerts a hydrostatic pressure ("hydrostatic head") on the power fluid 28 in the pump 200.

The pump 200 may contain reservoir fluid 32 in the production chamber 60, in the upper portion of the reset chamber 62, in the upper portion of the drive chamber 66, and in the transfer tube 80. The produced fluid conduit 30 may contain reservoir fluid 32. The column of fluid in the produced fluid conduit 30 may, or may not, extend from the pump 200 to the surface 34. The reservoir fluid 32 in the produced fluid conduit 30 may be considered as a column of reservoir fluid 32 that exerts a hydrostatic pressure ("hydrostatic head") on the reservoir fluid 32 in the pump 200.

The pump 200 may contain a third fluid 124 in the lower portion of the reset chamber 62. The third fluid 124 may include fluid that is present external to, and surrounding, the housing 48. In some embodiments where the pump 200 may be at least partially immersed in reservoir fluid 32, the third fluid 124 in the lower portion of the reset chamber 62 may include reservoir fluid 32. In some embodiments, where the pump 200 may be at least partially immersed in a fluid other than reservoir fluid 32, the third fluid 124 in the lower portion of the reset chamber 62 may include the fluid other than reservoir fluid 32. The fluid other than reservoir fluid 32 may include any one or more of the power fluid 28, water, a brine, a hydrocarbon, or combination(s) thereof.

In some embodiments, the power fluid 28 may have a density that is less than the density of the reservoir fluid 32. In some embodiments, the power fluid 28 may have a density that is substantially the same as the density of the reservoir fluid 32. In some embodiments, the power fluid 28 may include a hydrocarbon liquid. In some embodiments, the power fluid 28 may include water.

FIG. 6 shows the pump 200 in operation during a first phase. The first phase may be referred to as a production stroke. For the pump 200 of FIG. 5, the production stroke is an up stroke of the pistons 70, 88, and 106. During a production stroke, a pressure may be applied to the power fluid 28 in the power fluid conduit 26. The pressure may be applied by a pulsar unit 42 at the surface 34, and the power fluid 28 in the power fluid conduit 26 may communicate the applied pressure to the pump 200. The power fluid 28 may communicate the applied pressure to the power fluid 28 contained in the power fluid passage 92, and hence to the power fluid 28 in the lower portion of the drive chamber 66 through the port 108. Thus, the power fluid 28 in the power fluid passage 92 and in the lower portion of the drive chamber 66 experiences a pressure that is substantially equal to the magnitude of the pressure applied at surface 34 plus the hydrostatic head provided by the column of power fluid 28 in the power fluid conduit 26 from the surface 34 to the pump 200.

During a production stroke, a pressure may, or may not, be applied at the surface 34 to the reservoir fluid 32 in the produced fluid conduit 30. A pressure applied to the reservoir fluid 32 in the produced fluid conduit 30 may be in the form of a back pressure that is exerted due to the flow of reservoir fluid 32 through the wellhead outlet 38 and through associated valves and/or other restrictions. In some embodiments, effectively no pressure is applied at the surface 34 to the reservoir fluid 32 in the produced fluid conduit 30. In some embodiments, a pressure that is negligible in magnitude is applied at the surface 34 to the reservoir fluid 32 in the produced fluid conduit 30. When the reservoir fluid 32 is moving through the pump 200 and through the produced fluid conduit 30, the reservoir fluid 32 may experience a back pressure due to the flow of the reservoir fluid 32 through the pump 200 and through the produced fluid conduit 30. Thus, the reservoir fluid 32 contained within the upper portion of the drive chamber 66 and the upper portion of the reset chamber 62 experiences a pressure that is substantially equal to the magnitude of any pressure applied at surface 34 plus any flow-generated back pressure plus the hydrostatic head provided by the column of reservoir fluid 32 in the produced fluid conduit 30.

By appropriate selection of the composition and density of the power fluid 28, and appropriate selection of the magnitude of the pressure applied at the surface 34 to the column of power fluid 28 in the power fluid conduit 26, the pressure experienced by the power fluid 28 in the lower portion of the drive chamber 66 may be greater than the pressure experienced by the reservoir fluid 32 in the upper portion of the drive chamber 66. Thus, the drive piston 106 may experience a pressure imbalance that urges the drive piston 106 upward.

The reset piston 88 experiences a net force resulting from the difference between the pressure experienced by the reservoir fluid 32 contained in the upper portion of the reset chamber 62 (described above) and the pressure experienced by the third fluid 124 contained in the lower portion of the reset chamber 62. In some embodiments, the pressure experienced by the reservoir fluid 32 contained in the upper portion of the reset chamber 62 may be greater than the pressure experienced by the third fluid 124 contained in the lower portion of the reset chamber 62. Hence, the reset piston 88 may experience a net force that urges the reset piston 88 downward, and may at least partially counteract the upward force experienced by the drive piston 106 because the drive piston 106 and the reset piston 88 are connected by transfer tube 80. Thus, the density of the power fluid 28 and/or the magnitude of the pressure applied at the surface 34 to the column of power fluid 28 in the power fluid conduit 26 may be selected such that the upward force exerted on the drive piston 106 exceeds the downward force exerted on the reset piston 88 plus any net downward force exerted on the production piston 70, thereby causing the drive piston 106 and the reset piston 88 to move upward.

Upward movement of the drive piston 106 reduces the volume of the upper portion of the drive chamber 66, and therefore forces at least a portion of the reservoir fluid 32 contained in the drive chamber 66 out through the connection 52 to the produced fluid conduit 30 and into the produced fluid conduit 30. Reservoir fluid 32 that is already in the produced fluid conduit 30 is thus moved upwards, and, with reference back to FIG. 1, reservoir fluid 32 at an upper end of the produced fluid conduit 30 is moved through the wellhead 36 and out through the outlet 38.

Upward movement of the reset piston 88 reduces the volume of the upper portion of the reset chamber 62, and therefore forces at least a portion of the reservoir fluid 32 contained in the reset chamber 62 through the port 102 and into the transfer tube 80. Also, some of the third fluid 124 external to the pump 200 is drawn into the lower portion of the reset chamber 62 through port 202.

As shown in FIG. 6, the transfer tube 80 couples the reset piston 88 with the production piston 70. Upward movement of the drive piston 106 coupled with the reset piston 88 causes upward movement of the production piston 70. Upward movement of the production piston 70 reduces the volume of the upper portion of the production chamber 60, and therefore forces at least a portion of the reservoir fluid 32 contained in the upper portion of the production chamber 60 through the port 84 and into the transfer tube 80.

Upward movement of the production piston 70 increases the volume of the lower portion of the production chamber 60, and therefore reduces the pressure of the reservoir fluid 32 contained within the lower portion of the production chamber 60. Since the pump 200 is in a wellbore 12, there is reservoir fluid 32 in the wellbore 12 outside the pump 200 in the vicinity of the reservoir fluid inlet 54. When the pressure of the reservoir fluid 32 in the wellbore 12 in the vicinity of the reservoir fluid inlet 54 exceeds the pressure of the reservoir fluid 32 contained within the lower portion of the production chamber 60 by a threshold magnitude, the standing valve 58 (if present) will open and continued upward movement of the production piston 70 may draw reservoir fluid 32 into the production chamber 60 through the reservoir fluid inlet 54.

The movement of reservoir fluid 32 into the pump 200 through the reservoir fluid inlet 54 may result in a localized reduction of pressure of the fluid in the wellbore 12 proximate to a zone of fluid influx 18 (FIG. 1). In some embodiments, the pressure in the wellbore 12 proximate to the zone of fluid influx 18 may be reduced to a magnitude less than the in situ pressure of the surrounding geological formation 16. Thus, there may be a drawdown pressure created that may provide a driving force to draw fluid contained within the surrounding geological formation 16 to flow toward, and into, the wellbore 12 at the zone of fluid influx 18. In some embodiments, the pressure in the wellbore 12 proximate to the zone of fluid influx 18 may be reduced to a magnitude that is, at least temporarily, significantly less than the in situ pressure of the surrounding geological formation 16. In some embodiments, the pressure in the wellbore 12 proximate to the zone of fluid influx 18 may be reduced to a magnitude that is, at least temporarily, substantially equal to atmospheric pressure. In some embodiments, the pressure in the wellbore 12 proximate to the zone of fluid influx 18 may be reduced to a magnitude that is, at least temporarily, less than atmospheric pressure.

Still referring to the upward movement of the production piston 70, the reduced pressure of the reservoir fluid 32 within the lower portion of the production chamber 60 and the forcing of reservoir fluid 32 out of the upper portion of the production chamber 60 into the transfer tube 80 results in the pressure of the reservoir fluid 32 in the transfer tube 80 at the first traveling valve 78 exceeding the pressure of the reservoir fluid 32 within the lower portion of the production chamber 60. Therefore, the first standing valve 58 will be held in a closed position, and will prevent fluid transfer between the transfer tube 80 and the lower portion of the production chamber 60. Thus, the reservoir fluid 32 that enters the transfer tube 80 through the through the port 84 travels upward through the transfer tube 80.

In the transfer tube 80, the second traveling valve 100 experiences a pressure from above derived at least in part from the pressure of the reservoir fluid 32 being moved out of the upper portion of the reset chamber 62. This fluid may travel relatively unhindered upward through the transfer tube 80, and be commingled with the reservoir fluid 32 within and moving out of the upper portion of the drive chamber 66 and into the produced fluid conduit 30. The second traveling valve 100 experiences a pressure from below derived at least in part from the pressure of the reservoir fluid 32 being moved out of the upper portion of the production chamber 60 and into the transfer tube 80. Because the standing valve 58 is closed, the only available flow path for this fluid is upward through the transfer tube 80. Continued upward movement of the production piston 70 forces more reservoir fluid 32 out of the upper portion of the production chamber 60 and into the transfer tube 80 toward the second traveling valve 100. Thus the pressure exerted by the reservoir fluid 32 in the transfer tube 80 below the second traveling valve 100 will increase until the pressure exerted by the reservoir fluid 32 in the transfer tube 80 below the second traveling valve 100 exceeds the pressure exerted by the reservoir fluid 32 in the transfer tube 80 above the second traveling valve 100 by a threshold value. At this point the second traveling valve 100 will open to allow the reservoir fluid 32 in the transfer tube 80 below the second traveling valve 100 to move through the second traveling valve 100 and commingle with the reservoir fluid 32 in the transfer tube 80 that is exiting the upper portion of the reset chamber 62.

Therefore, in summary, during a production stroke of the pistons 70, 88, and 106 in the pump 200, the standing valve 58 (if present) may open to allow reservoir fluid 32 into the lower portion of the production chamber 60, the first traveling valve 78 may close, the second traveling valve 100 may open, and reservoir fluid 32 in the upper portion of the production chamber 60 and in the upper portion of the reset chamber 62 may enter the transfer tube 80. Reservoir fluid 32 in the transfer tube 80 may flow out of the upper end of the transfer tube 80 and commingle with reservoir fluid 32 in the upper portion of the drive chamber 66. Reservoir fluid 32 in the upper portion of the drive chamber 66 may flow out of the pump 200 and into the produced fluid conduit 30. Additionally, reservoir fluid 32 may move upward through the produced fluid conduit 30, and reservoir fluid 32 may flow out of the produced fluid conduit 30 at the surface 34 and through the outlet 38 of the wellhead 36.

With the pump 200 as illustrated in FIG. 6, the transfer tube 80 is placed in axial tension during a production stroke by the action of the drive piston 106 and/or the reset piston 88 pulling the production piston 70. By being in axial tension rather than axial compression, the transfer tube 80 may be less susceptible to buckling. Hence, such a risk of buckling may not inhibit the effective configuration of the operating conditions for the production stroke. Thus, for example, a rate of travel of the pistons 70, 88, and 106 during the production stroke may be regulated as required to suit the desired operational circumstances for each wellbore 12. The enabling of such regulation may facilitate effective control of the rate at which fluids from the geological formation 16 move into the wellbore 12 and become drawn into the pump 200.

FIG. 7 illustrates operation of the pump 200 during a second phase. The second phase may be referred to as a reset stroke. For the pump 200 of FIG. 5, the reset stroke is a down stroke of the pistons 70, 88, and 106. A reset stroke may be initiated at the surface 34 by a release of pressure that had been applied to the power fluid 28 in the power fluid conduit 26 during the production stroke. The release of pressure may be performed by the pulsar unit 42, such as by reversing a movement of piston 44 in cylinder 46 (FIG. 1). The release of pressure may bring the magnitude of the pressure applied at surface 34 down to substantially equal atmospheric pressure. The release of pressure may bring the magnitude of the pressure applied at surface 34 down to a value that is above atmospheric pressure. The release of pressure may bring the magnitude of the pressure applied at surface 34 down to a value that is less than atmospheric pressure, in other words at least a partial vacuum.

The reduction of the pressure applied at surface 34 to the column of power fluid 28 in the power fluid conduit 26 results in a reduction of the pressure experienced by the power fluid 28 within the lower portion of the drive chamber 66. By appropriate selection of the power fluid 28, and particularly the density of the power fluid 28, the pressure of the power fluid 28 in the lower portion of the drive chamber 66 will be less than the pressure of the reservoir fluid 32 within the upper portion of the drive chamber 66. Additionally, or alternatively, a pressure may be applied at surface 34 to the reservoir fluid 32 in the production conduit. Hence, the drive piston 106 may experience a pressure imbalance that urges the drive piston 106 to move downward.

The reset piston 88 experiences a net force resulting from the difference between the pressure experienced by the reservoir fluid 32 contained in the upper portion of the reset chamber 62 (described above) and the pressure experienced by the third fluid 124 contained in the lower portion of the reset chamber 62. In some embodiments, the pressure experienced by the reservoir fluid 32 contained in the upper portion of the reset chamber 62 may be greater than the pressure experienced by the third fluid 124 contained in the lower portion of the reset chamber 62. Hence, the reset piston 88 may experience a net force that urges the reset piston 88 downward.

Downward movement of the reset piston 88 results in reservoir fluid 32 within the upper portion of the drive chamber 66 being drawn into the upper portion of the reset chamber 62 through the transfer tube 80 and port 102. Some of the third fluid 124 in the lower portion of the reset chamber 62 is expelled through port 202. Downward movement of the drive piston 106 results in reservoir fluid 32 within the produced fluid conduit 30 being drawn into the upper portion of the drive chamber 66. Downward movement of the drive piston 106 also results in power fluid 28 being forced out of the lower portion of the drive chamber 66 and into the power fluid passage 92. Power fluid 28 in the power fluid passage 92 may be forced into the power fluid conduit 26.

Downward movement of the drive piston 106 and the reset piston 88 also causes downward movement of the production piston 70 because of the coupling between the pistons provided by the transfer tube 80. Downward movement of the production piston 70 results in enlargement of the upper portion of the production chamber 60, which causes a localized reduction in pressure.

Because of the port 84, this reduction in pressure is also experienced by the reservoir fluid 32 in the portion of the transfer tube 80 between the first traveling valve 78 and the second traveling valve 100. The pressure the reservoir fluid 32 will be substantially equal to the full hydrostatic head of the column of the reservoir fluid 32 in the produced fluid conduit 30, and hence the pressure of the reservoir fluid 32 below the second traveling valve 100 will become less than the pressure of the reservoir fluid 32 above the second traveling valve 100. Thus, the second traveling valve 100 will close, thereby preventing passage of fluid therethrough.

Downward movement of the production piston 70 also reduces the size of the lower portion of the production chamber 60, which causes therein a localized increase in pressure. When the pressure of the reservoir fluid 32 in the lower portion of the production chamber 60 exceeds the pressure of the reservoir fluid 32 above the first traveling valve 78 by a threshold magnitude, the first traveling valve 78 will open, thereby allowing reservoir fluid 32 to flow from the lower portion of the production chamber 60 into the transfer tube 80 and through the port 84 into the upper portion of the production chamber 60. Additionally, the increased pressure in the lower portion of the production chamber 60 will cause the standing valve 58 (if present) to close, thereby preventing reservoir fluid 32 from transferring between the lower portion of the production chamber 60 and the exterior of the pump 200.

Therefore, in summary, during a reset stroke of the pistons 70, 88, and 106 in the pump 200, the standing valve 58 (if present) may close to prevent reservoir fluid 32 in the lower portion of the production chamber 60 from exiting the pump 200 through the reservoir fluid inlet 54. Additionally, the first traveling valve 78 may open, the second traveling valve 100 may close, and reservoir fluid 32 in the lower portion of the production chamber 60 may flow into the upper portion of the production chamber 60. Some reservoir fluid 32 in the transfer tube 80 below the second traveling valve 100 may also flow into the upper portion of the production chamber 60. Some reservoir fluid 32 in the produced fluid conduit 30 may flow back into the upper portion of the drive chamber 66, and may flow through the portion of the transfer tube 80 above the second traveling valve 100 into the upper portion of the reset chamber 62. Furthermore, some power fluid 28 in the lower portion of the drive chamber 66 may flow into the power fluid passage 92, and may flow into the power fluid conduit 26.

Pump 200 operation continues as described above with a repeated sequence of a production stroke followed by a reset stroke. Thus, reciprocal action of the pistons of the pump 200 results in the production of reservoir fluid 32 to the surface 34. Because pump 200 operates by the sequential drawing and expelling of reservoir fluid 32 into and out of the production chamber 60 by production piston 70, pump 200 may be considered as a positive displacement pump.

Figure 8:
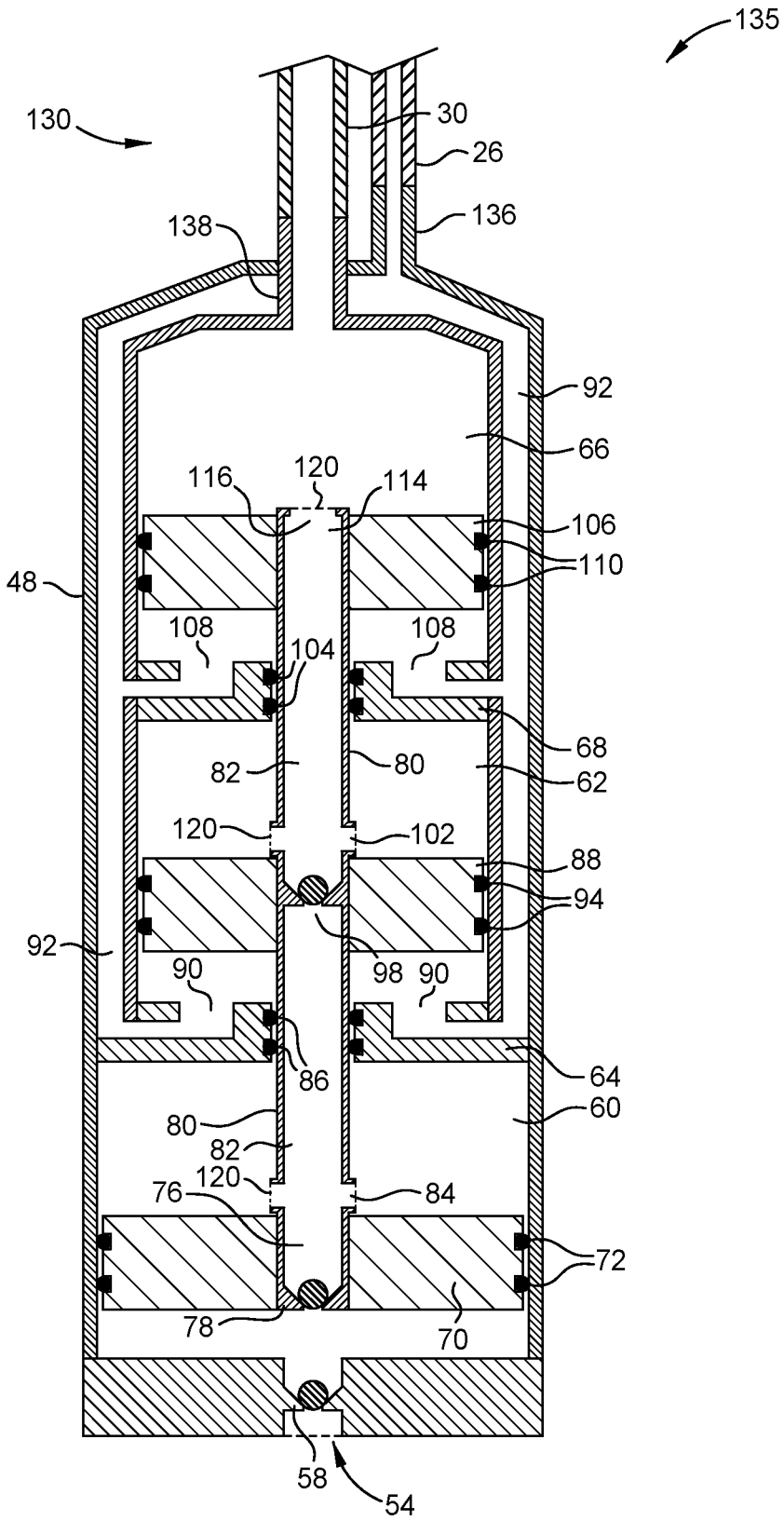
FIG. 8 is a schematic illustration of an embodiment of a pump of the present disclosure.
Figure 9:
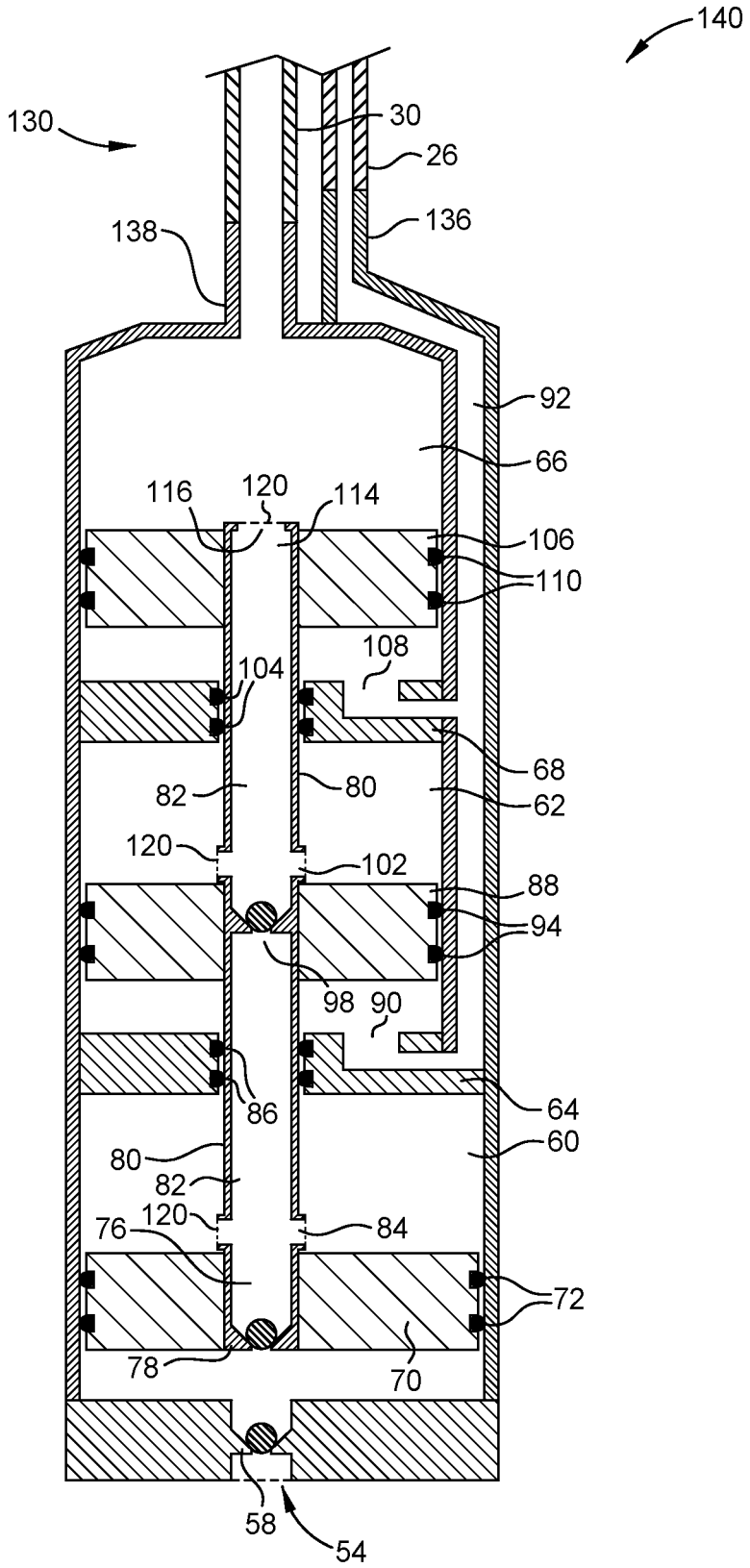
FIG. 9 is a schematic illustration of an embodiment of a pump of the present disclosure.

FIGS. 8 and 9 are schematic longitudinal cross-sectional views illustrating alternative configurations of pump 10 and a connected tubing string. Where possible, the reference numbers of components of FIG. 2 have been preserved for similar components of FIGS. 8 and 9. In FIGS. 8 and 9, tubing string 130 is shown in place of the tubing string 20 as having a produced fluid conduit 30 and a power fluid conduit 26 positioned side-by-side. Pump 135 in FIG. 8 is similar to pump 10, but has connection 136 to power fluid conduit 26 in place of the connection 50 of pump 10, and has connection 138 to produced fluid conduit 30 in place of the connection 52 of pump 10. Pump 140 in FIG. 9 is similar to pump 10, but has connection 142 to power fluid conduit 26 in place of the connection 50 of pump 10, and has connection 144 to produced fluid conduit 30 in place of the connection 52 of pump 10. Pumps 135 and 140 operate in a similar way to pump 10, and therefore may be considered as positive displacement pumps.

Figure 10:
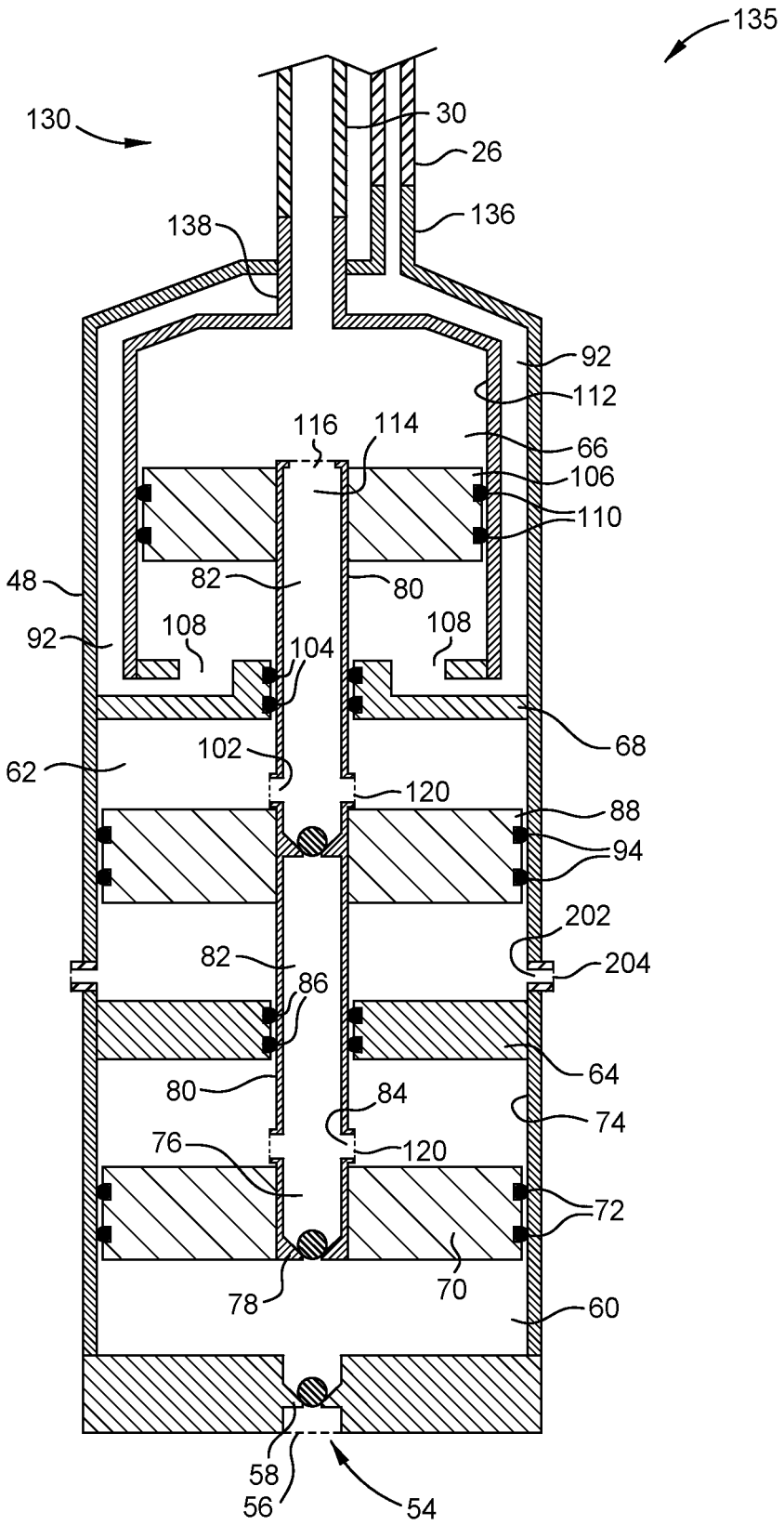
FIG. 10 is a schematic illustration of an embodiment of a pump of the present disclosure.
Figure 11:
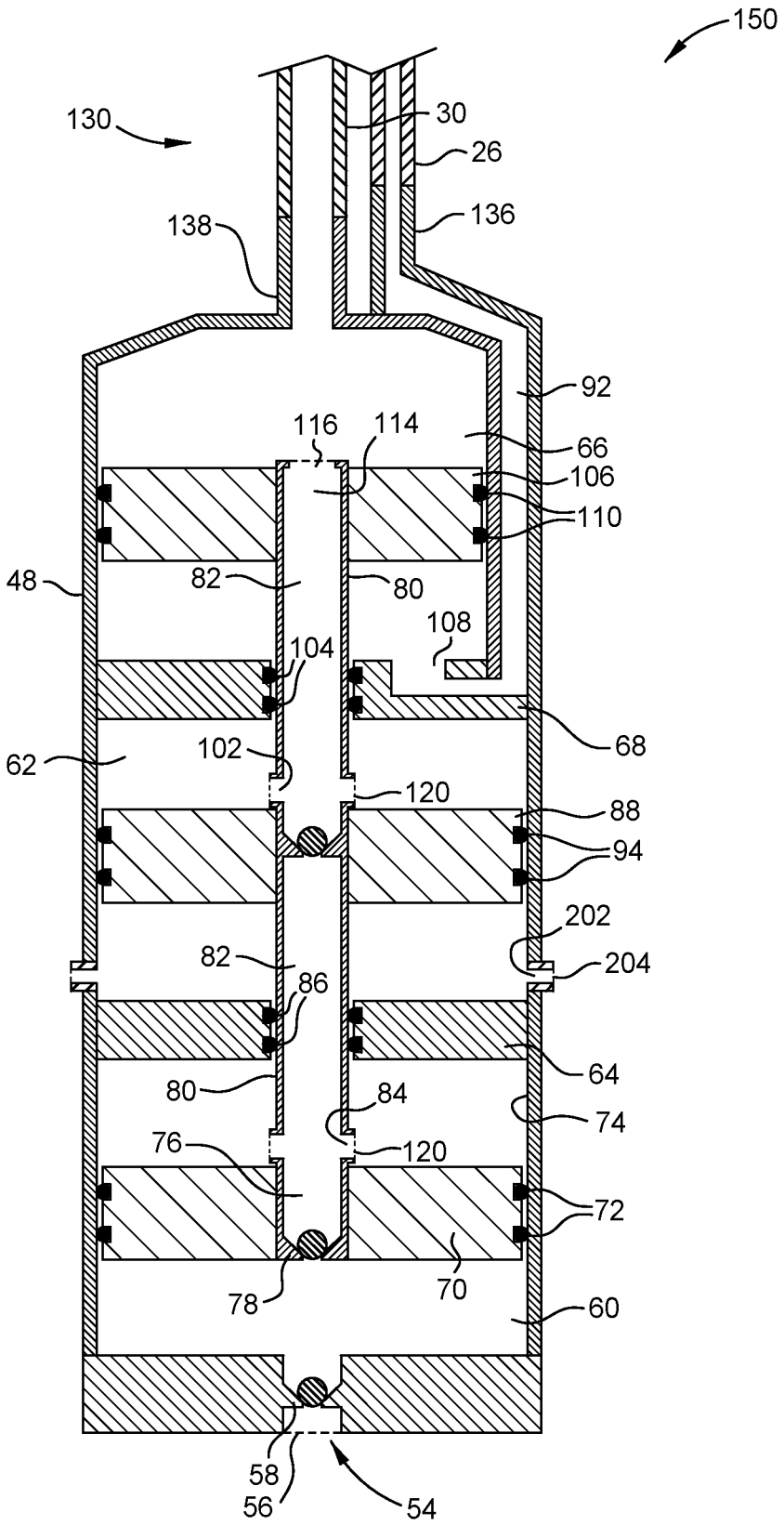
FIG. 11 is a schematic illustration of an embodiment of a pump of the present disclosure.

FIGS. 10 and 11 are schematic longitudinal cross-sectional views illustrating alternative configurations of pump 200 and a connected tubing string. Where possible, the reference numbers of components of FIG. 5 have been preserved for similar components of FIGS. 10 and 11. In FIGS. 10 and 11, tubing string 130 is shown in place of the tubing string 20 as having a produced fluid conduit 30 and a power fluid conduit 26 positioned side-by-side. Pump 145 in FIG. 10 is similar to pump 200, but has connection 136 to power fluid conduit 26 in place of the connection 50 of pump 200, and has connection 138 to produced fluid conduit 30 in place of the connection 52 of pump 200. Pump 150 in FIG. 11 is similar to pump 200, but has connection 142 to power fluid conduit 26 in place of the connection 50 of pump 200, and has connection 144 to produced fluid conduit 30 in place of the connection 52 of pump 200. Pumps 145 and 150 operate in a similar way to pump 200, and therefore may be considered as positive displacement pumps.

In some embodiments of deployment of any of pumps 10, 200, 135, 140, 145, and 150, a string of tubulars serving as a power fluid conduit 26 may be omitted, for example, when the annulus between the produced fluid and the casing 14 (FIG. 1) is used as the power fluid conduit 26.

In some embodiments of pumps 10, 200, 135, and 145, the power fluid passage 92 may be annular. In some embodiments of pumps 10, 200, 135, 140, 145, and 150, the power fluid passage 92 may include one or more fluid pathways running along one or more sides of the housing 48, such as in the arrangements depicted in FIGS. 9 and 11. In some embodiments of pumps 10, 200, 135, 140, 145, and 150, the power fluid conduit 26 may extend from the pump 10, 200, 135, 140, 145, 150 below the pump 10, 200, 135, 140, 145, 150 and connect to another tool, such as another pump 10, 200, 135, 140, 145, 150. In such embodiments, the extension of the power fluid conduit 26 may be in the form of a small diameter tubular, such as a capillary line.

Pumps of the present disclosure (such as pumps 10, 200, 135, 140, 145, 150) have a number of advantages over conventional pumps of the genre. For example, a typical pump of the genre experiences a load on the piston assembly during a production stroke that is greater than a load on the piston assembly during a reset stroke. Conventional pumps of the genre have a connecting rod, not a transfer tube, linking a drive piston with a production piston, and the production stroke is a down-stroke. Thus, the operation that places the greatest load on a piston assembly of a conventional pump subjects the connecting rod to axial compression, and places the connecting rod at risk of buckling. Seals around the connecting rod may fail due to the connecting rod buckling, resulting in the conventional pump of the genre losing efficiency due to leakage.

In contrast, by having the power fluid acting on the drive piston from below instead of from above, the production stroke of a pump of the present disclosure is an up-stroke instead of a down-stoke. The benefit of this is huge in that the transfer tube experiences a tensile load instead of a compressive load when a pump of the present disclosure is enduring the typical high loads of the production stroke. The tensile load mitigates buckling. The load experienced during a reset stroke is typically lower than the load experienced during a production stroke. Hence, the transfer tube of a pump of the present disclosure experiences a compressive load during the reset stroke that is lower than the compressive load experienced by the connecting rods of conventional pumps. Therefore the transfer tube is not exposed to the same buckling risk as the connecting rods of conventional pumps.

In the limited diameters of wellbores, pump production and drive chambers tend to be long, and thus connecting rods tend to be long. With respect to the buckling risk described above, the advantage possessed by pumps of the present disclosure over conventional pumps is magnified for pumps having longer production and drive chambers.

Additionally, the transfer tube provides for a more space-efficient design than that of conventional pumps because a volume of reservoir fluid may be held in the transfer tube during operation. Thus, a pump of the present disclosure can have a diameter and a capacity equivalent to those of a conventional pump, but can be shorter than the equivalent conventional pump, and therefore would be easier to transport and install. Furthermore, the space efficiency allows for the transfer tube to have a larger diameter than a connecting rod of a conventional pump, which further provides resistance to buckling under axial compression. The space efficiency also allows a pump of the present disclosure to have a longer stroke capability than that of a conventional pump, increasing the production volume.

The dual traveling valve system of pumps of the present disclosure facilitates a simple and easy method of capturing and transferring fluids produced from a reservoir. The components of the piston assembly of a pump of the present disclosure, including the transfer tube and the traveling valves may be modular, and thus may be simple to replace during repair or maintenance.

FIGS. 12 to 15 illustrate some exemplary configurations for deployment of a pump of the present disclosure. A pump of the present disclosure may be deployed in a wellbore 12, and be positioned within or proximate to a zone of fluid influx 18 in which a reservoir fluid 32 flows from a geological formation 16 into the wellbore 12. In some embodiments, a pump of the present disclosure may be deployed in a section of the wellbore 12 that is substantially vertical. In some embodiments, a pump of the present disclosure may be deployed in a section of the wellbore 12 that is not substantially vertical. In some embodiments, a pump of the present disclosure may be deployed in a section of the wellbore 12 that is substantially straight. In some embodiments, a pump of the present disclosure may be deployed in a section of the wellbore 12 that is curved. In some embodiments, a pump of the present disclosure may be deployed in a section of the wellbore 12 that is deviated from vertical, such as in a section of the wellbore 12 that is oriented at an angle of about 70 degrees to about 90 degrees, about 80 degrees to about 90 degrees, or substantially 90 degrees (i.e. horizontal) with respect to vertical.

As illustrated in FIGS. 12 to 15, a pump of the present disclosure may be deployed with a packer in a wellbore 12. The pump may be positioned proximate to a zone of fluid influx 18 such that the pump is near or within the zone of fluid influx 18. The pump may be positioned such that a reservoir fluid inlet 54 of the pump is above, within, or below the zone of fluid influx 18. The packer may be positioned proximate to an upper end of the zone of fluid influx 18. The packer may be positioned so as to separate the zone of fluid influx 18 from the portion of the wellbore 12 that extends from the zone of fluid influx 18 to the surface 34. In some embodiments, a pump of the present disclosure is coupled to a tubing string. In some embodiments, the packer is coupled to the tubing string. In some embodiments, a pump of the present disclosure is coupled to the packer.

As illustrated in FIGS. 12 to 15, a zone of fluid influx 18 may include one or more points of fluid entry 155 into the wellbore 12. The one or more points of fluid entry 155 may be perforations that extend through a casing or liner and into a geological formation, such as geological formation 16. The one or more points of fluid entry 155 may be interfaces between portions of a geological formation, such as geological formation 16, and the wellbore 12. As illustrated in FIGS. 12 to 15, a wellbore 12 may have a casing 14. The casing 14 may include any one or more of a casing, a liner, a slotted liner, a pre-perforated liner, or a sand control screen. In some embodiments, the casing 14 may be omitted near or within the zone of fluid influx 18.

Figure 12:
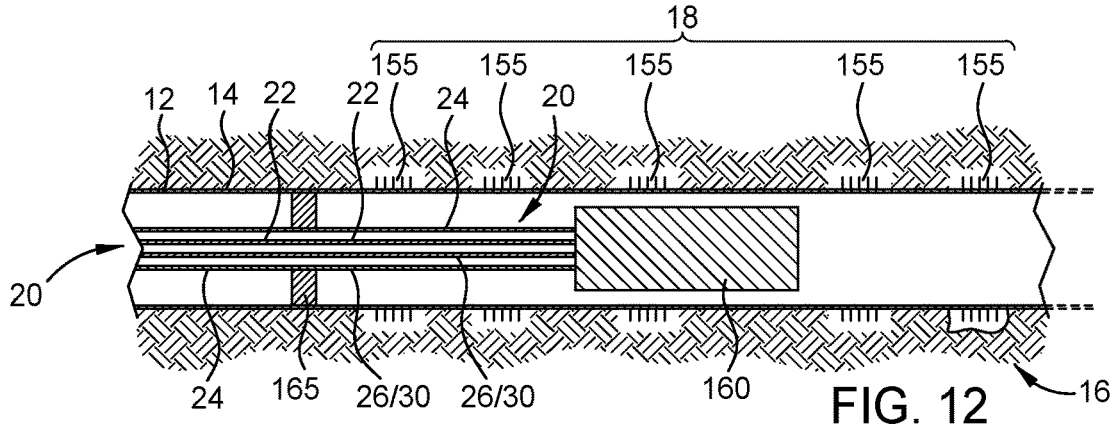
FIG. 12 is a schematic illustration of a wellbore with a pump installed according to an embodiment of the present disclosure.
Figure 13:
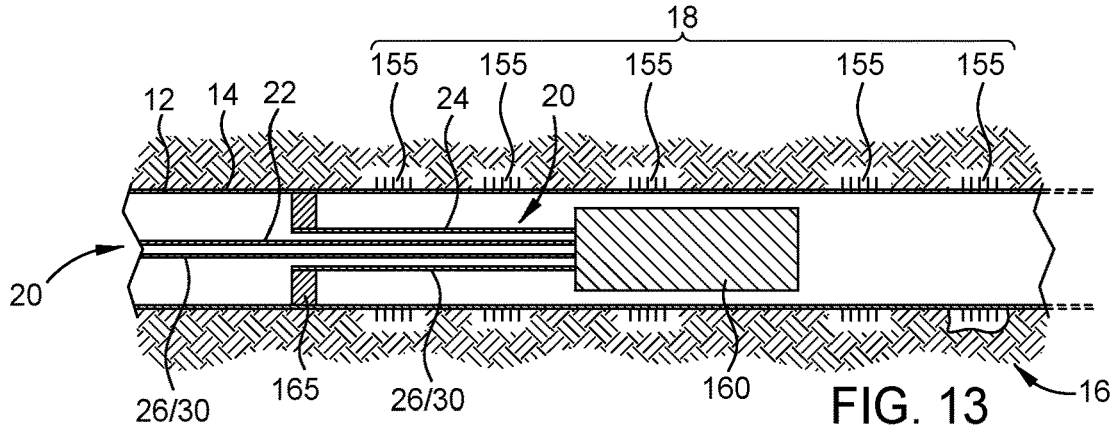
FIG. 13 is a schematic illustration of a wellbore with a pump installed according to an embodiment of the present disclosure.
Figure 14:
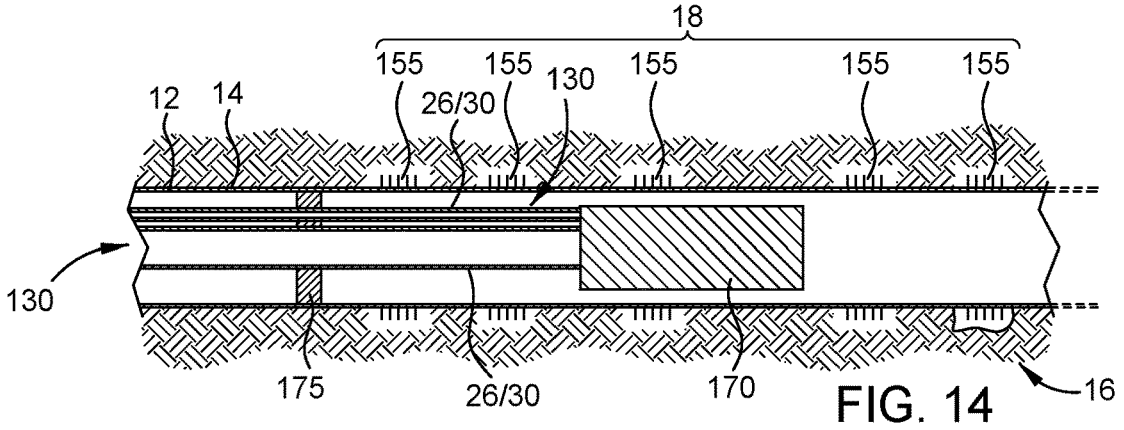
FIG. 14 is a schematic illustration of a wellbore with a pump installed according to an embodiment of the present disclosure.
Figure 15:
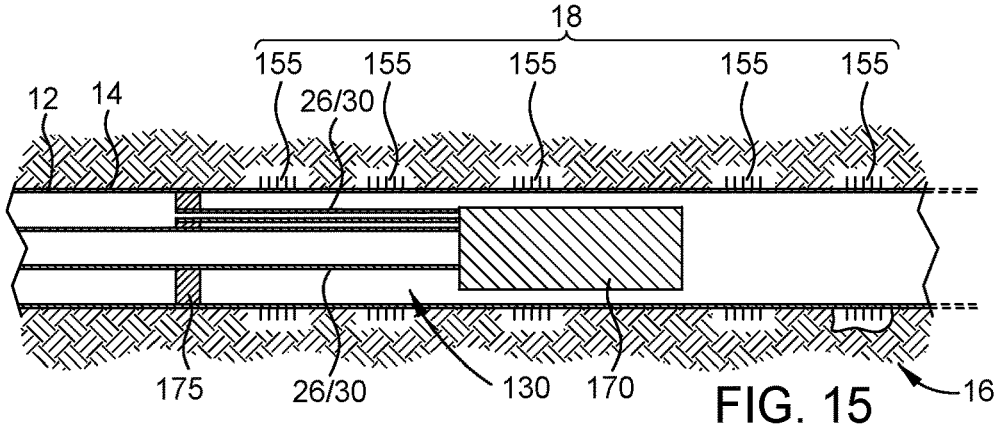
FIG. 15 is a schematic illustration of a wellbore with a pump installed according to an embodiment of the present disclosure.

FIGS. 12 and 13 illustrate configurations in which pump 160 may be any suitable type of pump, such as a centrifugal pump, jet pump, or the like. In some embodiments, pump 160 may be a positive displacement pump, such as a rod lift pump or a hydraulic pump, such as pumps 10 or 200. FIGS. 14 and 15 illustrate configurations in which pump 170 may be any suitable type of pump, such as a centrifugal pump, jet pump, or the like. In some embodiments, pump 170 may be a positive displacement pump, such as a rod lift pump or a hydraulic pump, such as pumps 135, 140, 145, or 150.

In some embodiments, as illustrated in FIG. 12, pump 160 may be connected to a tubing string 20 that includes one tubular inside another tubular. The tubing string 20 of such a configuration may extend from the pump 160 to a packer 165, and from the packer 165 to the surface 34 (see FIG. 1). The packer 165 may seal the annulus between the tubing string 20 and a wall of the wellbore 12, such as casing 14. In some embodiments, the inner tubular 22 may be a produced fluid conduit 30 and the outer tubular 24 may be a power fluid conduit 26. In other embodiments, the inner tubular 22 may be a power fluid conduit 26 and the outer tubular 24 may be a produced fluid conduit 30. In some embodiments, the inner tubular 22 may be a small diameter tubular, such as capillary line.

In some embodiments, as illustrated in FIG. 13, pump 160 may be connected to a tubing string 20 that includes one tubular inside another tubular, and the tubing string 20 of such a configuration may extend from the pump 10 to the packer 165, similar to the arrangement depicted in FIG. 12. However, the outer tubular 24 may terminate at or proximate to the packer 165, whereas the inner tubular 22 may extend from the packer 165 to the surface 34. The packer 165 may seal the annulus between the tubing string 20 and the casing 14. In some embodiments, the inner tubular 22 may be a produced fluid conduit 30 and the outer tubular 24 (and the annulus between the inner tubular 22 and the casing 14 above the packer 165) may be a power fluid conduit 26. In other embodiments, the inner tubular 22 may be a power fluid conduit 26 and the outer tubular 24 (and the annulus between the inner tubular 22 and the casing 14 above the packer 165) may be a produced fluid conduit 30. In some embodiments, the inner tubular 22 may be a small diameter tubular, such as capillary line.

In some embodiments, as illustrated in FIG. 14, pump 170 may be connected to a tubing string 130 that includes one tubular side-by-side with another tubular. The tubing string 130 of such a configuration may extend from the pump 170 to the packer 175, and from the packer 175 to the surface 34. The packer 175 may seal the annulus between the tubing string 20 and the casing 14. In some embodiments, one tubular may be a produced fluid conduit 30 and the other tubular may be a power fluid conduit 26. In some embodiments, one tubular may be a small diameter tubular, such as a capillary line.

In some embodiments, as illustrated in FIG. 15, pump 170 may be connected to a tubing string 130 that includes one tubular side-by-side with another tubular, and the tubing string 130 of such a configuration may extend from the pump 170 to the packer 175. However, one tubular may terminate at or proximate to the packer 175, whereas the other tubular may extend from the packer 175 to the surface 34. The packer 175 may seal the annulus between the tubing string 20 and the casing 14. In some embodiments, one tubular may be a produced fluid conduit 30 and the other tubular (and the annulus between the tubular that extends to the surface 34 and the casing 14 above the packer 175) may be a power fluid conduit 26. In other embodiments, one tubular may be a power fluid conduit 26 and the other tubular (and the annulus between the tubular that extends to the surface 34 and the casing 14 above the packer 175) may be a produced fluid conduit 30. In some embodiments, the tubular that extends to the surface 34 may be a small diameter tubular, such as a capillary line.

In some embodiments, such as some of those illustrated in FIGS. 12 to 15, the pump 160, 170 may be configured to have a reservoir fluid inlet 54 that is positioned at or proximate to a low side of the wellbore 12. Such a positioning may be useful in promoting the pump 10 operating to draw in liquids rather than gas.

Operation of the pumps 160, 170 in the configurations illustrated in FIGS. 12 to 15 may cause fluid in the surrounding geological formation 16 to move toward the zone of fluid influx 18, move into the wellbore 12 at the zone of fluid influx 18, move through the pumps 160, 170, move into the produced fluid conduit 30, move through the produced fluid conduit 30 to the surface 34, and move through the outlet 38 of the wellhead 36 (see FIG. 1). In the illustrated embodiments of FIGS. 12 to 15, all the reservoir fluid that originates from the zone of fluid influx 18 and becomes produced from the wellbore 12 passes through the pumps 160, 170.

Operation of the pumps 160, 170 to move reservoir fluid 32 into the pumps 160, 170 through the reservoir fluid inlet 54 may create a drawdown pressure that may provide a driving force to draw fluid contained within the surrounding geological formation 16 to flow toward, and into, the wellbore 12 at the zone of fluid influx 18. The packers 165, 175 inhibit fluid that is in the wellbore 12 above the packers 165, 175 from moving into the zone of fluid influx 18. Therefore, the packers 165, 175 create a sealed volume in the wellbore 12 containing the pumps 160, 170, respectively. Thus, a drawdown applied by any one of pumps 160, 170 is not significantly offset by a change in level of a fluid surrounding pumps 160, 170. Hence, in embodiments in which pumps 160, 170 are positive displacement pumps, operation of the pumps 160, 170 to draw reservoir fluids into the pumps 160, 170 may, at least temporarily, significantly reduce the pressure of fluids within the wellbore 12 proximate to the zone of fluid influx 18.

In some embodiments, the pressure in the wellbore 12 proximate to the zone of fluid influx 18 may be reduced to a magnitude that is, at least temporarily, significantly less than the in situ pressure of fluids in the surrounding geological formation 16. In some embodiments, the pressure in the wellbore 12 proximate to the zone of fluid influx 18 may be reduced to a magnitude that is, at least temporarily, about 1,000 psi (68.9 bar) or less, about 500 psi (34.5 bar) or less, about 250 psi (17.2 bar) or less, about 200 psi (13.8 bar) or less, about 150 psi (10.3 bar) or less, about 100 psi (6.9 bar) or less, or about 50 psi (3.4 bar) or less. In some embodiments, the pressure in the wellbore 12 proximate to the zone of fluid influx 18 may be reduced to a magnitude that is, at least temporarily, substantially equal to atmospheric pressure. In some embodiments, the pressure in the wellbore 12 proximate to the zone of fluid influx 18 may be reduced to a magnitude that is, at least temporarily, less than atmospheric pressure.

The pressure in the wellbore 12 proximate to the zone of fluid influx 18 may be reduced to a magnitude that promotes fluid in the surrounding geological formation 16 to flow toward and enter the wellbore 12 at the zone of fluid influx 18. The fluid may be drawn into the wellbore from the portion of the geological formation 16 above the wellbore 12, from the portion of the geological formation 16 to the side of wellbore 12, and even from the portion of the geological formation 16 below the wellbore 12. Thus, where the in situ pressure of the geological formation 16 is already low, and there exists no other drive mechanism in the geological formation 16 to encourage fluids to migrate towards the wellbore 12, the pump arrangements of FIGS. 12 to 15 may enable the production of fluids that otherwise would not be produced.

A further production benefit concerns embodiments in which the pumps 160, 170 include a standing valve, such as standing valve 58. In such embodiments, operation of the pumps 160, 170 during a reset stroke will not exhaust fluids out of the pump 10 through the reservoir fluid inlet 54. Thus, fluids may not re-enter the zone of fluid influx 18 from the pumps 160, 170. Additionally, the packers 165, 175 inhibit fluid that is in the wellbore 12 above the packers 165, 175 from moving into the zone of fluid influx 18. Hence, the drawdown pressure that drew fluid contained within the surrounding geological formation 16 into the wellbore 12 at the zone of fluid influx 18 may be at least partially maintained during a reset stroke of the pumps 160, 170 until sufficient fluid has passed from the surrounding geological formation 16 into the wellbore 12 in order to equalize the pressure within the wellbore at the zone of fluid influx 18 with the pressure of the fluid in the surrounding geological formation 16. Therefore, if the surrounding geological formation 16 is one of relatively low permeability (such as 1 mD or less), fluids may be drawn from the surrounding geological formation 16 into the wellbore 12 at the zone of fluid influx 18 both during a production stroke of the pumps 160, 170 and at least partly during a reset stroke of the pumps 160, 170.

The creation of a drawdown pressure may encourage dissolved gasses in the reservoir fluids to emerge out of solution and become present as free gas. In some embodiments, such emergence of free gas may be controlled, or limited, or inhibited by controlling the rate of travel of the production piston 70 of pumps 160, 170 during a production stroke. The rate of travel of the production piston 70 during a production stroke may be controlled by controlling the rate of travel of the drive piston 106. The rate of travel of the drive piston 106 may be controlled by the rate of travel of the pulsar piston 44. Additionally, or alternatively, the rate of travel of the drive piston 106 may be controlled by the regulation of pressure exerted by the pulsar piston 44 on the power fluid 28 in the power fluid conduit 26. Additionally, or alternatively, the rate of travel of the drive piston 106 may be controlled by the regulation of back pressure exerted on the reservoir fluid 32 in the produced fluid conduit 30.

In some embodiments, the pumps 10, 200, 135, 140, 145, 150 may be configured such that the production chamber 60 is relatively long, such as up to six feet (1.83 m). Such a configuration may facilitate an appropriate control of the rate of travel of the production piston 70. For example, a constant relatively slow rate of travel may be difficult to achieve, and the effect of this on the operation of different pumps may be more or less dramatic. In the following example, a first pump may have a production chamber 60 of a given volume that is relatively short in length and relatively wide. A second pump may have a production chamber 60 of the same volume that is relatively long and relatively narrow. It follows that at any selected rate of travel of the production piston 70 of each example pump, the rate of change in volume of the portion of the production chamber 60 below the production piston 70 would be greater for the first example pump than for the second example pump. Hence, the rate at which dissolved gasses may emerge out of solution and become present as free gas within or proximate to the production chamber 60 will be greater with the first example pump than with the second example pump. Thus, by utilizing the second pump of this example, an operator may be better able to control the evolution of free gas. Such a configuration may be beneficial for the pumps 160, 170 in the deployments illustrated in FIGS. 12 to 15.

While the foregoing is directed to embodiments of the present disclosure, other and further embodiments of the disclosure may be devised without departing from the basic scope thereof, and the scope thereof is determined by the claims that follow.

What is claimed is:

1. A pump comprising:
- a drive chamber;
- a reset chamber;
- a production chamber having a fluid inlet configured to permit entry of fluids external to the pump into the production chamber; and
- a piston assembly comprising:
  - a drive piston axially movable within the drive chamber,
  - a reset piston axially movable within the reset chamber,
  - a production piston axially movable within the production chamber,
  - a tube coupling the drive piston with the production piston, and
  - a first traveling valve axially separated from a second traveling valve.

2. The pump of claim 1, wherein the fluid inlet includes:
- a standing valve;
- a filter; or
- a combination of a standing valve and a filter.

3. The pump of claim 1, wherein the reset piston is coupled to the tube between the drive piston and the production piston.

4. The pump of claim 3, wherein the first traveling valve is associated with the production piston and the second traveling valve is associated with the reset piston.

5. The pump of claim 4, wherein the first traveling valve and the second traveling valve are configured to permit fluid flow from the production chamber to the drive chamber, but inhibit fluid flow from the drive chamber to the production chamber.

6. The pump of claim 5, wherein:
- when the drive piston moves in a first direction, the first traveling valve closes and the second traveling valve opens; and
- when the drive piston moves in a second direction opposite to the first direction, the first traveling valve opens and the second traveling valve closes.

7. The pump of claim 1, further comprising a drive fluid passage fluidically coupling a portion of the reset chamber below the reset piston with a portion of the drive chamber below the drive piston.

8. The pump of claim 1, wherein the reset chamber has a port fluidically coupling a portion of the reset chamber below the reset piston with an exterior of the pump.

9. A method of operating a pump in a wellbore, comprising:

applying a pressure via a drive fluid to a drive piston in a drive chamber, thereby:

moving the drive piston in a first direction;

moving a reset piston in the first direction within a reset chamber; and moving a production piston in the first direction;

causing, by moving the production piston in the first direction, a first traveling valve associated with the production piston to close; and causing, by moving the production piston in the first direction, a second traveling valve above the first traveling valve, between the drive piston and the production piston, to open.

10. The method of claim 9, further comprising drawing a reservoir fluid into a lower portion of a production chamber below the production piston while the production piston moves in the first direction.

11. The method of claim 10, further comprising:

releasing pressure from the drive fluid after moving the drive piston in the first direction, thereby:

moving the drive piston in a second direction opposite the first direction and moving the production piston in the second direction;

causing the first traveling valve to open; and causing the second traveling valve to close.

12. The method of claim 11, wherein moving the drive piston and the production piston in the second direction moves the reservoir fluid in the lower portion of the production chamber through the first traveling valve into an upper portion of the production chamber above the production piston.

13. The method of claim 12, further comprising reapplying the pressure to the drive piston, thereby:

moving the drive piston and the production piston in the first direction; and moving the reservoir fluid in the upper portion of the production chamber through the second traveling valve into an upper portion of the drive chamber above the drive piston.

14. The method of claim 13, wherein moving the drive piston in the first direction causes the reservoir fluid in the upper portion of the drive chamber to exit the pump.

15. A method of producing fluid from a wellbore comprising:

operating a pump located proximate to a zone of fluid influx in the wellbore to draw a reservoir fluid from a reservoir into the wellbore at the zone of fluid influx, wherein:

the pump comprises:

a drive chamber;

a reset chamber;

a production chamber having a fluid inlet configured to permit entry of fluids external to the pump into the production chamber; and a piston assembly comprising:

a drive piston axially movable within the drive chamber;

a reset piston axially movable within the reset chamber;

a production piston axially movable within the production chamber;

a tube coupling the drive piston with the production piston; and a first traveling valve axially separated from a second traveling valve;

the pump is coupled to a tubing string extending above the pump; and a packer coupled to the tubing string proximate to an upper end of the zone of fluid influx seals an annular space around the tubing string; and operating the pump to produce the reservoir fluid from the wellbore through the tubing string.

16. The method of claim 15, wherein the pump is a positive displacement pump, and is located in a section of the wellbore oriented at an angle of about 70 degrees to about 90 degrees with respect to vertical.

17. The method of claim 16, wherein operating the pump to draw the reservoir fluid from the reservoir into the wellbore further comprises creating a pressure within the zone of fluid influx of 250 psi or less.

18. The method of claim 16, wherein operating the pump to draw the reservoir fluid from the reservoir into the wellbore further comprises drawing reservoir fluid from a portion of the reservoir below the wellbore.

* * * * *